US008696224B2

(12) United States Patent
Kanda et al.

(10) Patent No.: US 8,696,224 B2
(45) Date of Patent: Apr. 15, 2014

(54) BOOKLET PAGE TURNING APPARATUS, BOOKLET PAGE TURNING METHOD, AND ID PRINTING APPARATUS

(75) Inventors: Mitsuyoshi Kanda, Tokyo (JP); Akihiro Yamazaki, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 939 days.

(21) Appl. No.: 12/822,171

(22) Filed: Jun. 23, 2010

(65) Prior Publication Data

US 2010/0328695 A1 Dec. 30, 2010

(30) Foreign Application Priority Data

Jun. 24, 2009 (JP) ..... 2009-150042

(51) Int. Cl.

| | |
|---|---|
| ***B42D 9/04*** | (2006.01) |
| ***B41J 13/00*** | (2006.01) |
| ***B41J 29/38*** | (2006.01) |
| ***B41J 3/28*** | (2006.01) |

(52) U.S. Cl.
CPC .. *B41J 3/283* (2013.01); *B42D 9/04* (2013.01)
USPC ..... 400/24; 40/531

(58) Field of Classification Search
CPC ..... B41J 3/283
USPC ..... 400/24; 40/531; 84/486
See application file for complete search history.

(56) References Cited

U.S. PATENT DOCUMENTS

| | | | | |
|---|---|---|---|---|
| 6,606,807 | B1 * | 8/2003 | Nakamura | 40/476 |
| 7,714,221 | B2 | 5/2010 | Ishioka | 84/519 |

FOREIGN PATENT DOCUMENTS

| | | | | | |
|---|---|---|---|---|---|
| EP | 0 439 934 | | | 8/1991 | |
| EP | 1 707 385 | A2 | | 10/2006 | |
| JP | 01206097 | A | * | 8/1989 | B42D 9/04 |
| JP | 02301489 | A | * | 12/1990 | B42D 9/04 |
| JP | 03-284993 | | | 12/1991 | |
| JP | 2001071664 | A | * | 3/2001 | B42D 9/04 |
| JP | 2001225571 | A | * | 8/2001 | B42D 9/04 |
| JP | 2009-279925 | | | 12/2009 | |
| WO | WO 01/54918 | | | 8/2001 | |

OTHER PUBLICATIONS

European Search Report dated Sep. 17, 2010.

* cited by examiner

*Primary Examiner* — Daniel J Colilla
(74) *Attorney, Agent, or Firm* — Pillsbury Winthrop Shaw Pittman, LLP

(57) ABSTRACT

According to one embodiment, a control device which controls to, after the feed device has fed the booklet so as to bring the page on the other surface side of the booklet into contact with the contact roller unit and fold the page on the other surface side, feed the booklet to the page turning position again.

20 Claims, 35 Drawing Sheets

BOOKLET PAGE TURNING APPARATUS, BOOKLET PAGE TURNING METHOD, AND ID PRINTING APPARATUS

CROSS-REFERENCE TO RELATED APPLICATIONS

This application is based upon and claims the benefit of priority from Japanese Patent Application No. 2009-150042, filed Jun. 24, 2009; the entire contents of which are incorporated herein by reference.

FIELD

Embodiments described herein relate generally to a booklet page turning apparatus which is mounted in, e.g., a booklet issuing machine to automatically turn the pages of a booklet, a booklet page turning method, and an ID printing apparatus.

BACKGROUND

In financial agencies and the like, automated teller machines that handle banknotes are installed, and transactions can automatically be recorded in booklets.

The booklet recording unit includes a page turning apparatus for turning pages. The page turning apparatus turns and finds a page of a booklet to be printed.

Booklets are not always inserted in a normal state with the front cover up, and may be inserted in various states. For example, a booklet may be inserted in an inverted state with its back cover up.

In this case, conventionally, the machine needs to (1) temporarily feed the inserted booklet back to the booklet insertion unit and return it to the user so that he/she can reverse the booklet and insert it again with the front cover up, or (2) solely repeat the operation of turning the inner sheets of the booklet until reaching the page on the front cover side.

However, the method (1) is troublesome for the user, and the method (2) requires a longer process time as the number of pages of the booklet increases.

To solve these problems, a booklet reversing apparatus is provided adjacent to the turning apparatus. The booklet is sent to the booklet reversing apparatus and reversed to make the front cover face up. The reversed booklet is sent to the turning apparatus to perform the turning operation from the front cover side.

The reversing apparatus comprises, for example, a holding plate configured to hold the fed booklet. A rotation mechanism rotates the holding plate by 180° to reverse the booklet.

However, since this method needs the extra reversing apparatus for reversing the booklet, the apparatus becomes bulky.

To solve this problem, an apparatus has been developed, which opens the back cover of a booklet inserted in a back cover face-up state, and then lifts the pages on the front cover side together with the front cover and closes them at once, thereby making the front cover side face up.

Some recent booklets have pages with high flexural rigidity as a part of adding values. For example, there are a booklet that includes an ID page with a security protection layer to prevent forgery and alteration of personal information, and a booklet that has a plastic sheet-like page incorporating an IC chip to allow high-density recording. There also exists a booklet that has a wireless IC chip so as to enable noncontact information read/write. Some of these booklets impart a radio shielding function to the front and back covers to protect recorded information against unauthorized read/write. A booklet of this type is read- and write-accessible only when the front cover is open.

In the apparatus that lifts the pages on the front cover side of a booklet together with the front cover and closes them at once, the pages to be closed at once are lifted while being sandwiched almost at the central portion by a pair of feed rollers. If the booklet is soft with low flexural rigidity, the pages can be bent and lifted. However, if the booklet is hard with high flexural rigidity, the pages cannot be lifted. If the pages are forced up, the booklet may break.

DETAILED DESCRIPTION

In general, according to one embodiment, a control device (40) which controls to, after the feed device (2*a*-2*d*) has fed the booklet (T) so as to bring the page on the other surface side of the booklet (T) into contact with the contact roller unit (21*a*) and fold the page on the other surface side, feed the booklet to the page turning position (5) again.

Hereinafter An embodiment of the present invention will now be described in detail with reference to the accompanying drawing.

Figure 1:
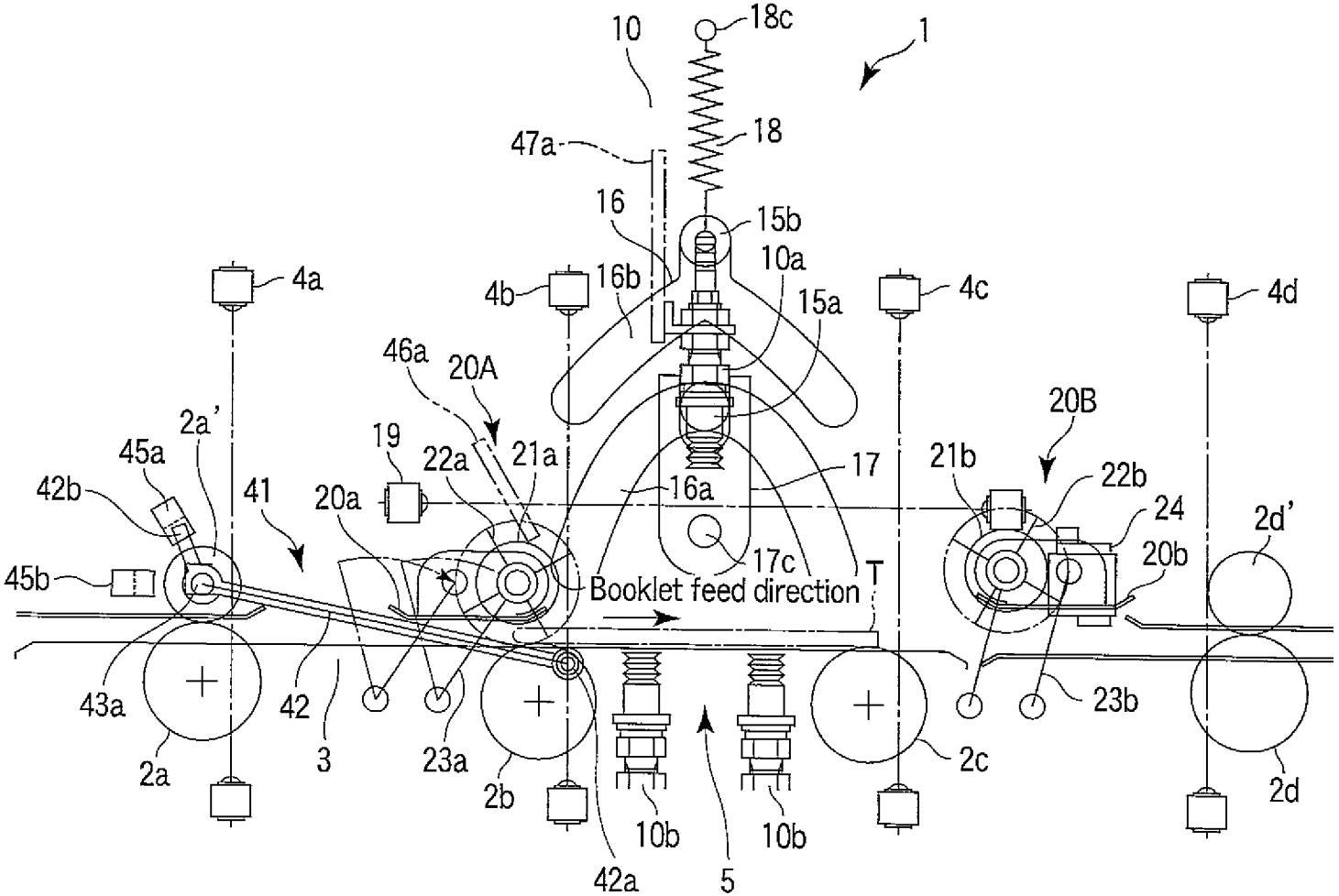
FIG. 1 is a view showing a booklet page turning apparatus according to an embodiment of the present invention.

FIG. 1 is a view showing a booklet page turning apparatus 1 according to the first embodiment of the present invention.

Reference numeral 3 in FIG. 1 denotes a feed path to feed a booklet T. The feed path 3 includes a plurality of feed rollers 2*a* to 2*d* serving as a feed device and detection sensors 4*a* to 4*d* which optically detect the booklet T, all of which are disposed at predetermined intervals along the feed direction of the booklet T. Pinch rollers 2*a*' and 2*d*' are in rolling contact with the upper portions of the feed rollers 2*a* and 2*d*, respectively. The feed rollers 2*b* and 2*c* are arranged at a page turning position 5. A feed roller driving motor 26 shown in FIG. 5 rotatably drives the feed rollers 2*a* to 2*d*.

Figure 5:
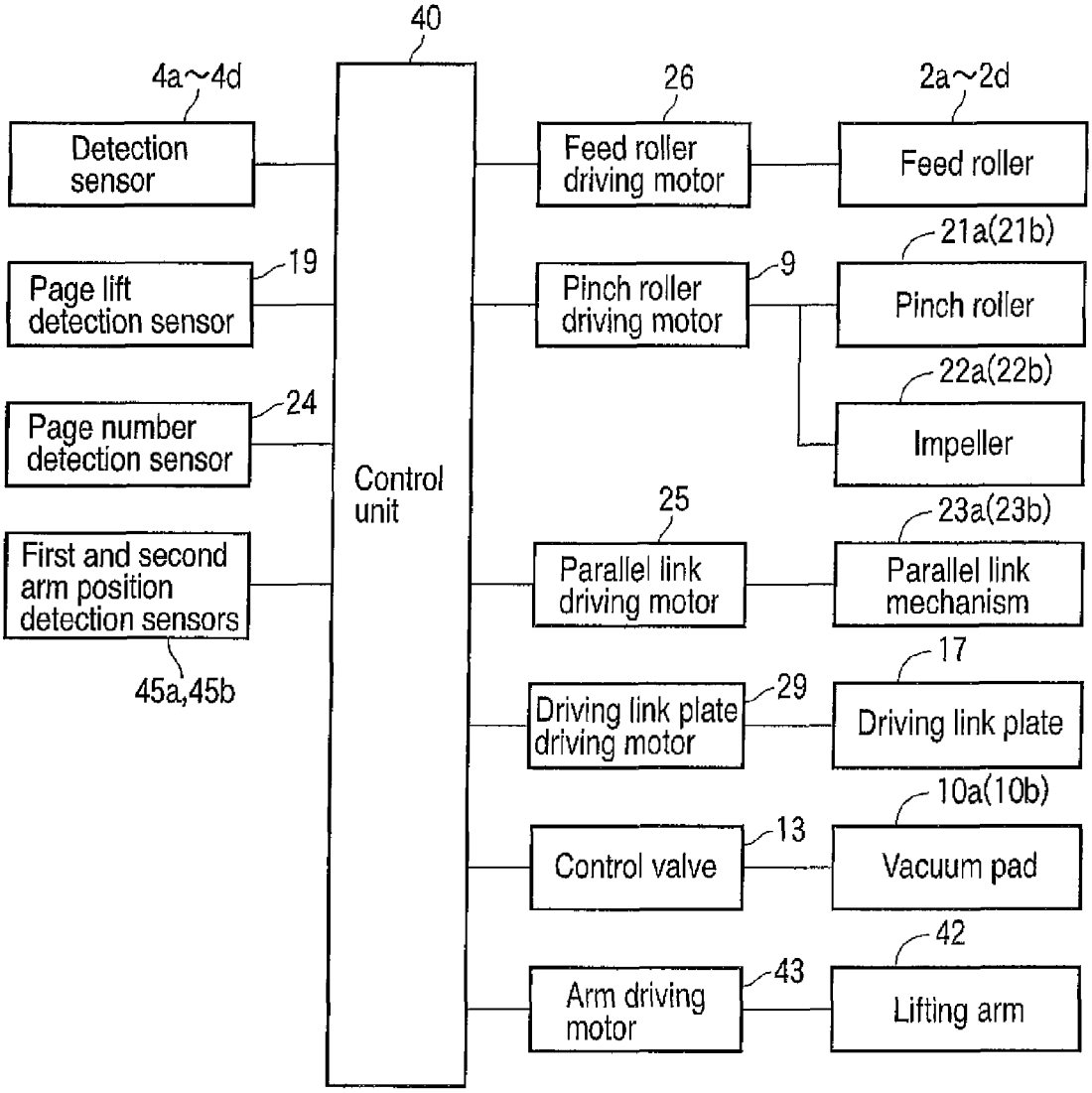
FIG. 5 is a block diagram showing the driving control system of the page turning apparatus in FIG. 1.

Contact feed mechanisms 20A and 20B are disposed above the feed rollers 2*b* and 2*c*, respectively. A page lift detection sensor 19 which optically detects a page sucked and lifted by vacuum pads 10*a* to be described later is provided above the page turning position 5. A page number detection sensor 24 which detects the page number of a turned page is provided near the contact feed mechanism 20B. The above-described detection sensors 4*a* and 4*d*, page lift detection sensor 19, and page number detection sensor 24 are connected to a control unit 40 serving as a control device via signal circuits, as shown in FIG. 5.

Figure 2:
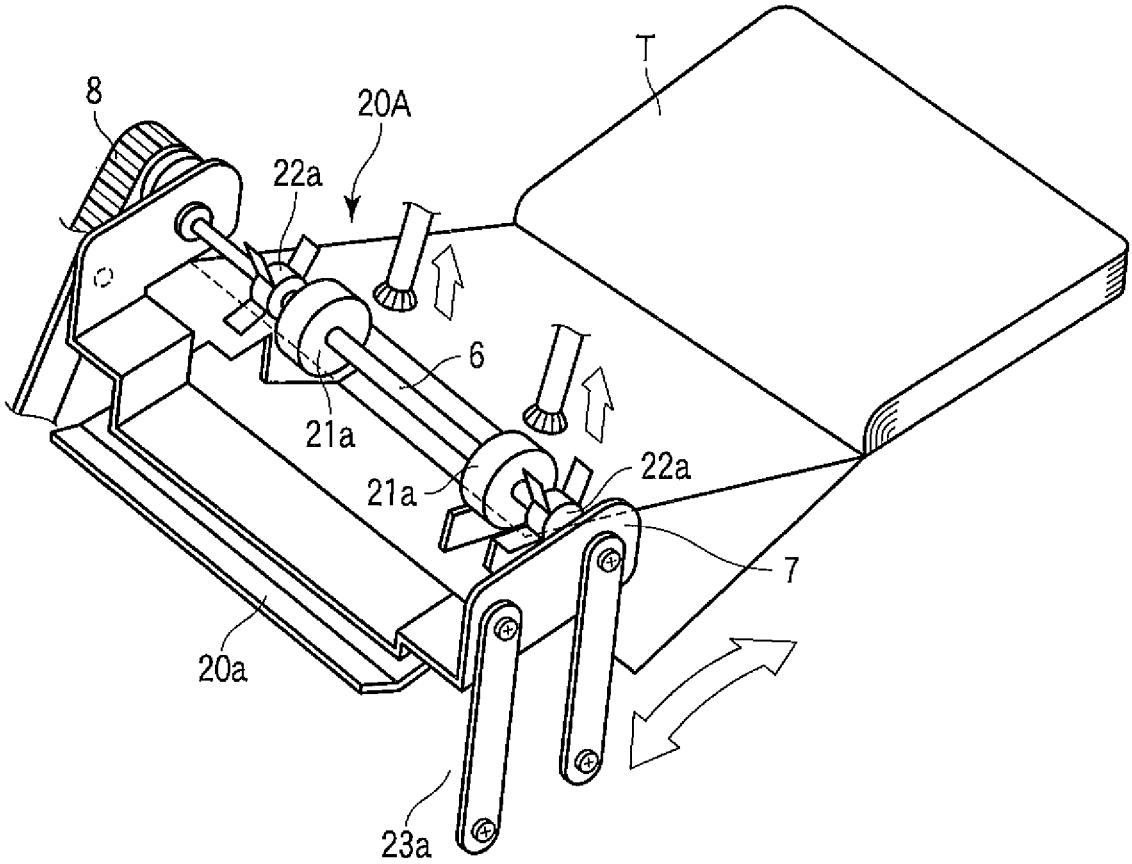
FIG. 2 is a perspective view showing the pinch rollers and impellers of the page turning apparatus in FIG. 1 and a driving system therefor.

The contact feed mechanism 20A comprises pinch rollers 21*a* serving as a contact roller unit. The pinch rollers 21*a* are attached to a shaft 6, as shown in FIG. 2. Impellers 22*a* are also attached to the shaft 6 near the pinch rollers 21*a*. Each impeller 22*a* has a plurality of flexible beating plates disposed radially on the circumferential surface. When rotating, the impellers 22*a* bring the beating plates into contact with the booklet T to beat down the pages under the page to be turned.

FIG. 2 illustrates the driving system of the pinch rollers 21*a* and the impellers 22*a*.

A support bracket 7 rotatably supports the shaft 6. One end of the shaft 6 projects outward from the support bracket 7. The projecting portion of the shaft 6 is connected to a pinch roller driving motor 9 (shown in FIG. 5) via a driving belt 8. When the pinch roller driving motor 9 is driven, the pinch rollers 21*a* and the impellers 22*a* rotate in the forward and backward directions.

A guide member 20*a* configured to guide feed of the booklet T is integrally attached to the support bracket 7. The support bracket 7 is supported by a parallel link mechanism 23*a*. A parallel link driving motor 25 (shown in FIG. 5) pivots the parallel link mechanism 23*a* in the forward and backward directions. As the parallel link mechanism 23*a* pivots, the guide member 20*a* moves, together with the pinch rollers 21*a* and the impellers 22*a*, between the feed position in vicinity of the feed roller 2*b* and the standby position off to the upper left of the feed position.

Note that the contact feed mechanism 20B has the same structure as the above-described contact feed mechanism 20A. More specifically, the contact feed mechanism 20B comprises a guide member 20*b*, pinch rollers (contact roller units) 21*b*, impellers 22*b*, and parallel link mechanism 23*b*. The contact feed mechanism 20B moves the guide member 20*b*, pinch rollers 21*b*, and impellers 22*b* between the feed position in vicinity of the feed roller 2*c* and the standby position off to the upper right of the feed position.

A turning suction mechanism 10 serving as a page turning device is provided at the above-described page turning position 5.

The turning suction mechanism 10 will be explained below with reference to FIG. 3.

The turning suction mechanism 10 comprises upper and lower vacuum pads 10*a* and 10*b* which are arranged on the upper and lower sides of the feed path 3. The lower vacuum pads 10*b* are attached with the suction ports being up so as to oppose the lower surface of the booklet T fed right above. The upper vacuum pads 10*a* are attached to a support carriage 15.

A pump 12 is connected to the vacuum pads 10*a* and 10*b* via a negative pressure supply circuit 11. The negative pressure supply circuit 11 comprises a filter 14 which separates dust from air sucked by a negative pressure, a control valve 13 which switches the negative pressure, and branch pipes 31*a* to 31*c*.

When the control valve 13 is opened, a negative pressure is generated in the vacuum pads 10*a* and 10*b* to suck the booklet T. A suction force W [N] of the vacuum pads 10*a* and 10*b* is given by $W=0.1\times P\times A/S$ P: vacuum pressure (gauge pressure) [−kPa]

A: vacuum pad area [$cm^2$]

S: safety factor

Bent surfaces 15A and 15B bent at a right angle are formed at the front and rear portions of the support carriage 15. Guide rings 15*a* and 15*b* are provided at the upper and lower portions of each of the bent surfaces 15A and 15B.

Guide plates 16 are disposed outside the bent surfaces 15A and 15B of the support carriage 15. Cam grooves 16*a* and 16*b* are formed at the upper and lower portions of each of the guide plates 16. The guide rings 15*a* and 15*b* of the bent surfaces 15A and 15B of the support carriage 15 fit in the cam grooves 16*a* and 16*b* of the guide plates 16, respectively.

The lower guide rings 15*a* of the bent surfaces 15A and 15B of the support carriage 15 fit in groove portions 17*a* of driving link plates 17 serving as a driving device. The driving link plates 17 are connected to a driving shaft 17*c*. The driving shaft 17*c* spans between the guide plates 16. A hand knob 26*a* is attached to one end of the driving shaft 17*c*. A driving link plate driving motor 29 is connected to the other end via a driving pulley 27 and a driving belt 28.

The shafts of the upper guide rings 15*b* of the bent surfaces 15A and 15B of the support carriage 15 are connected to hook portions 18*a* of the guide plates 16 via springs 18 to elastically bias the support carriage 15 upward.

When the driving link plate driving motor 29 is driven, the driving shaft 17*c* is rotated via the driving belt 28 and the driving pulley 27, and the driving link plates 17 pivot in the forward and backward directions (horizontal direction). Along with the pivotal motion, the guide rings 15*a* and 15*b* are guided via the two cam grooves 16*a* and 16*b* of each guide plate 16 so as to move the support carriage 15.

Note that in the initial state before the support carriage 15 moves, the driving link plates 17 stand at 12 o'clock, and the vacuum pads 10*a* supported by the support carriage 15 stand by at the upper standby position.

Figure 4:
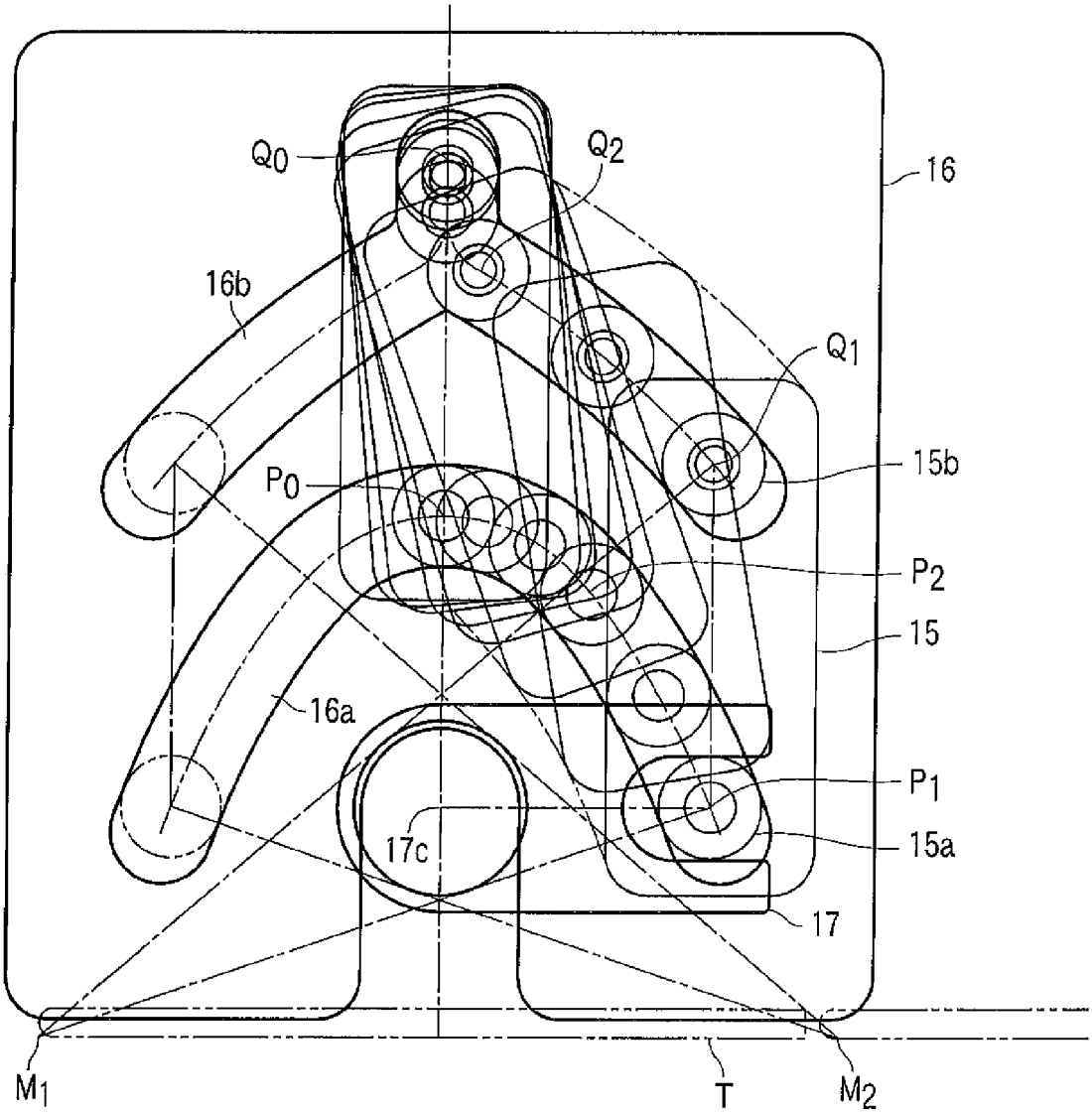
FIG. 4 is a view showing the moving locus of the vacuum pads in FIG. 3.

FIG. 4 shows the locus of the support carriage 15 which moves from the page turning position 5 of the booklet T along the cam grooves 16*a* and 16*b* of the guide plates 16.

$M_1$ indicates the binding position of the booklet T at the page turning start position; $M_2$, the binding position of the booklet T at the reverse page turning start position; $P_n$, a central position of the guide ring 15*a*; and $Q_n$, a central position of the guide ring 15*b*.

The position and orientation of the support carriage 15 are decided by two points corresponding to the central positions $P_n$ and $Q_n$ of the guide rings 15*a* and 15*b*. The vacuum pads 10*a* move together with the support carriage 15. More specifically, the cam grooves 16*a* and 16*b* of each guide plate 16 are formed to be bilaterally symmetrical and draw arcs with $M_1$ at the center between $P_1$ and $P_2$ and between $Q_1$ and $Q_2$, respectively. Hence, the vacuum pads 10*a* move about $M_1$ between $P_1$ and $P_2$ and between $Q_1$ and $Q_2$. This movement matches a turning operation using the binding portion of the uppermost page of the booklet T at the center of rotation.

In reverse page turning, the vacuum pads 10*a* move about $M_2$ in a direction reverse to that in the above-described page turning. This movement matches a reverse turning operation using the binding portion of the uppermost page of the booklet T at the center of rotation.

Note that the cam groove 16*a* has, between $P_0$ and $P_2$, an arc which smoothly connects curves formed by symmetrically extending the curve between $P_1$ and $P_2$. However, the cam groove 16*b* is formed, between $Q_0$ and $Q_2$, to linearly run upward in the direction of the axis of symmetry of the cam groove 16*b*.

Hence, the support carriage 15 decreases its tilt angle as it moves upward. When the central positions of the guide rings 15*a* and 15*b* reach $P_0$ and $Q_0$, the support carriage 15 returns to the upright state to locate the vacuum pads 10*a* at the upper standby position (initial position).

Figure 3:
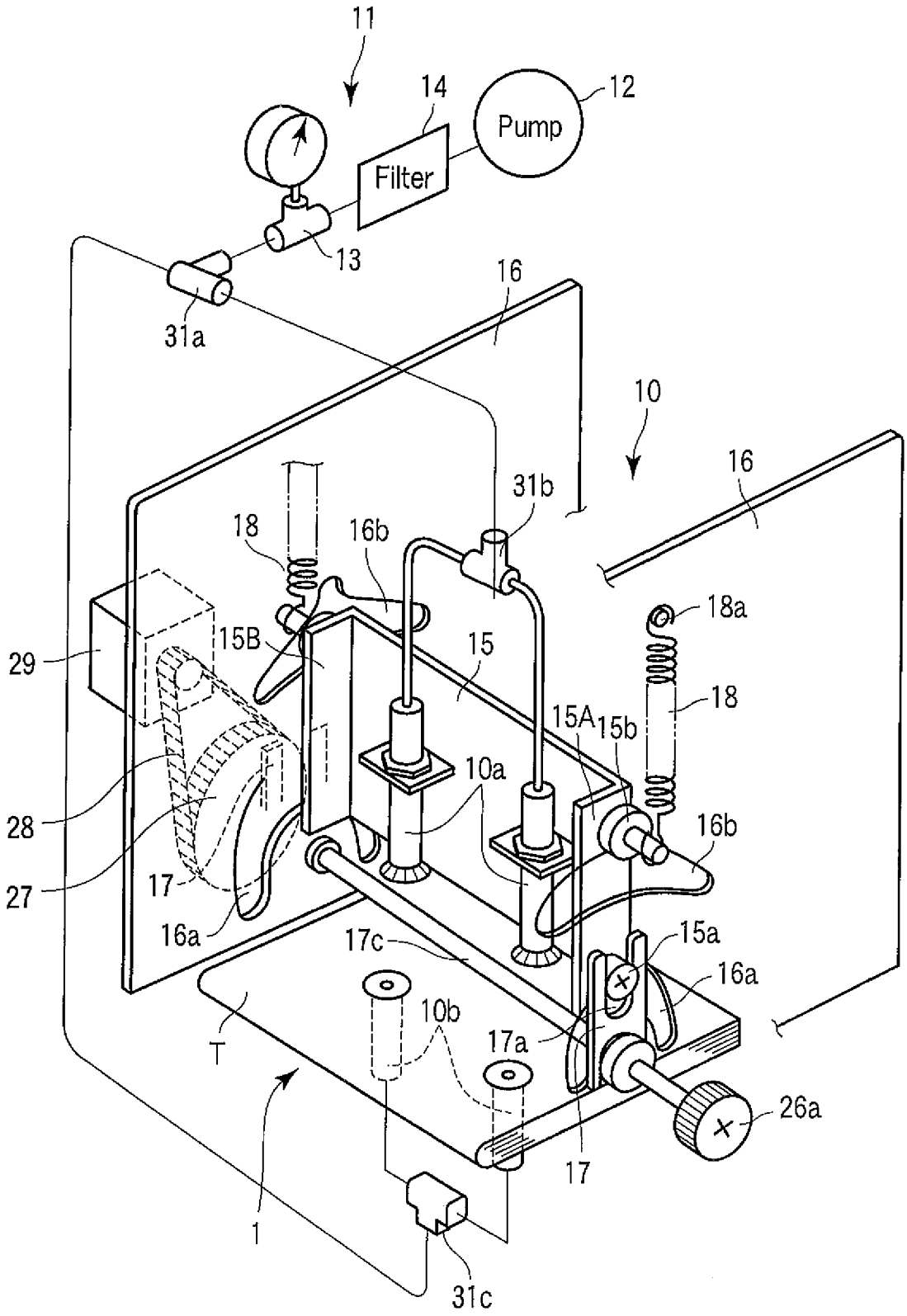
FIG. 3 is a perspective view showing the vacuum pads of the page turning apparatus in FIG. 1 and a driving system therefor.

At this time, the driving link plates 17 stand at 12 o'clock, as shown in FIG. 3. The driving link plates 17 can rotate clockwise and counterclockwise to move the support carriage 15 symmetrically. Since the maximum retreat position of the vacuum pads 10*a* in the page turning operation matches the turning start position of the reverse page turning operation, page turning and reverse page turning can be performed in a compact range.

Note that the binding position of the actual booklet T may sometimes shift from the position $M_1$ or $M_2$ because of the thickness of the booklet T, the manner the booklet T is bound, a high rigidity page arranged in the booklet T, or variations in the page turning start position caused by the feed operation. In the operation of lifting the uppermost page of the booklet T, the locus of the vacuum pads 10*a* is not ideal but shifted. However, this poses no serious problem because the lift angle is smaller than 45°, and a play allows to balance between the booklet T and the vacuum pads 10*a* and 10*b*. The play is ensured by elastic deformation of the vacuum pads 10*a* and 10*b* and elastic deformation of the booklet T near the binding portion.

FIG. 5 is a block diagram showing the driving control system of the above-described page turning apparatus.

The above-described detection sensors 4*a* to 4*d*, page lift detection sensor 19, and page number detection sensor 24 are connected to the control unit 40 serving as a control device via signal circuits. The driving motors 9, 25, 26, and 29 for the above-described pinch rollers, parallel links, feed rollers, and driving links, the control valve 13, and an arm driving motor 43 to be described later are connected to the control unit 40 via control circuits.

The control unit 40 controls driving the driving motors 9, 25, 26, and 29 and the control valve 13, thereby controlling the operations of the pinch rollers 21*a* and 21*b*, impellers 22*a* and 22*b*, parallel link mechanisms 23*a* and 23*b*, feed rollers 2*a* to 2*d*, driving link plates 17, vacuum pads 10*a* and 10*b*, and lifting arm 42 to be described later.

The page turning operation of the booklet T will be described next with reference to FIGS. 6 to 15.

Figure 6:
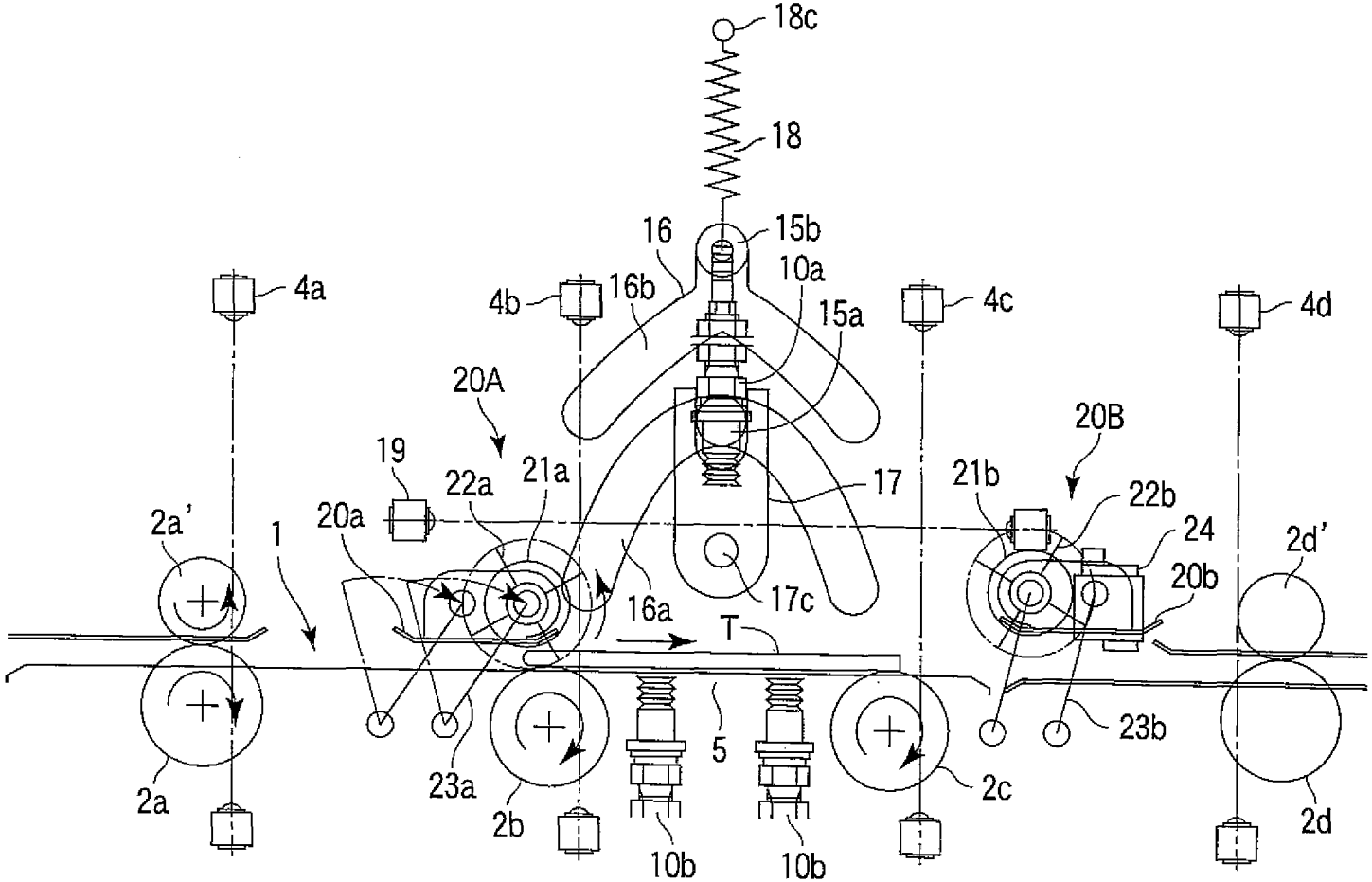
FIG. 6 is a view showing a state in which a booklet is fed to the page turning position in the page turning apparatus in FIG. 1.
Figure 7:
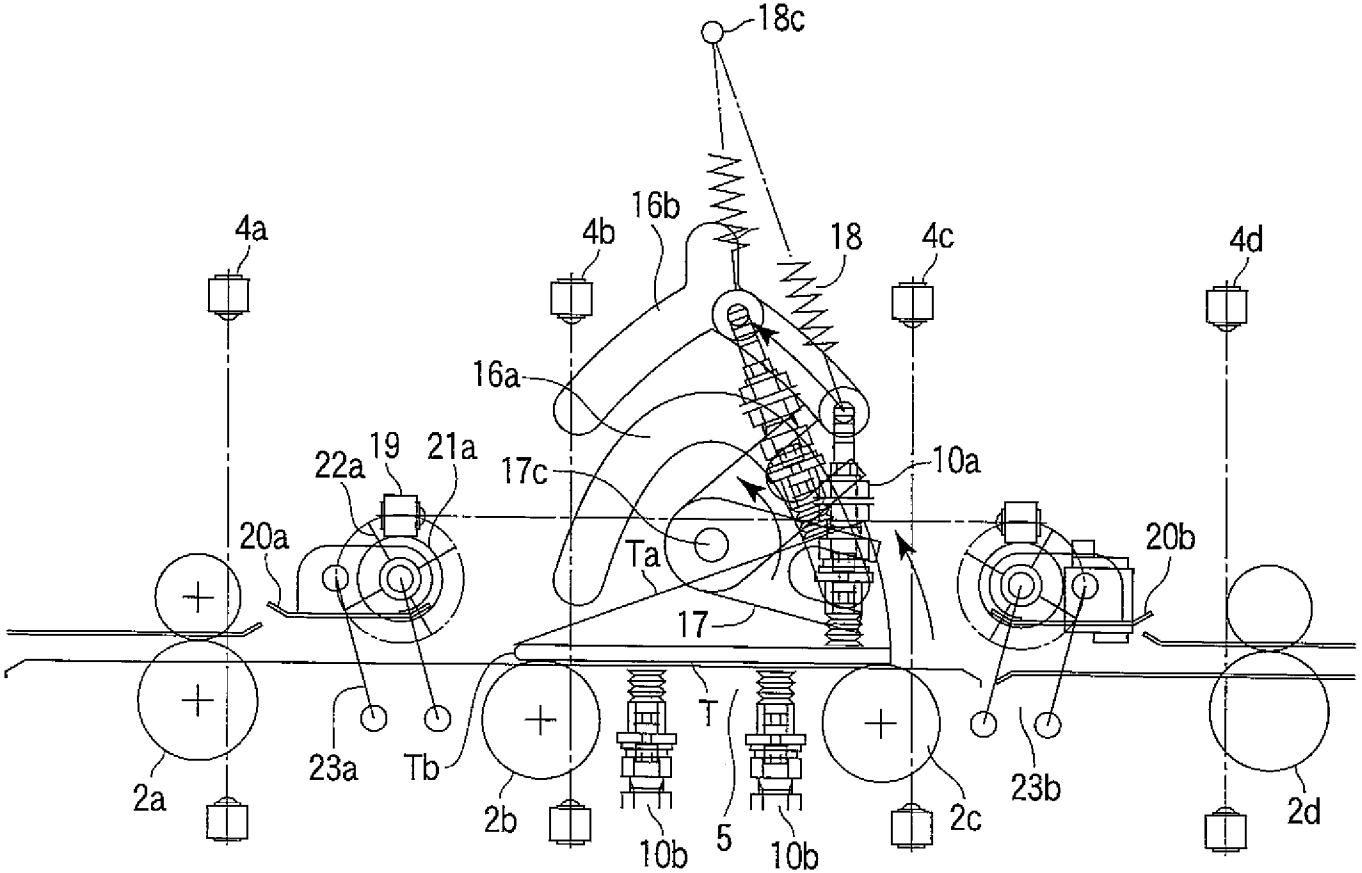
FIG. 7 is a view showing a state in which the vacuum pads lift the uppermost page of the booklet fed to the turning position in FIG. 6.

As the feed roller 2*a* rotates in the direction of the arrow, the booklet T is fed to the right side along the feed path 3. Upon this feed, when the booklet T is fed up to the detection sensor 4*b* and detected, the control unit 40 rotates the pinch rollers 21*a* and the impellers 22*a* in the direction of the arrow and also operates the parallel link mechanism 23*a*. When the parallel link mechanism 23*a* operates, the movable guide 20*a* moves from the standby position to the feed position together with the pinch rollers 21*a* and the impellers 22*a*, as shown in FIG. 6. The feed roller 2*b* and the pinch rollers 21*a* further feed the booklet T to the right side while sandwiching the booklet between them. Upon this feed, when the detection sensor 4*c* detects the booklet T, the feed roller 2*b* and the pinch rollers 21*a* rotate backward by a predetermined number of pulses. The booklet T is fed backward and stopped at the predetermined page turning start position 5. After that, the parallel link mechanism 23*a* operates in a direction reverse to the booklet feed direction to move the movable guide 20*a* from the feed position to the standby position together with the pinch rollers 21*a* and the impellers 22*a*, as shown in FIG. 7.

Meanwhile, the control valve 13 is operated to generate a negative pressure in the vacuum pads 10*a* and 10*b* so that the lower vacuum pads 10*b* suck and hold the lower surface of the booklet T. At this time, the driving link plate driving motor 29 is operated to make the driving arm plates 17 pivot clockwise so that the upper vacuum pads 10*a* come into contact with an uppermost page (front cover) Ta of the booklet T and suck it. After suction, the driving arm plates 17 pivot in the reverse direction (counterclockwise) and move upward along the loci of the cam grooves 16*a* and 16*b* of the guide plates 16 while the vacuum pads 10*a* keep sucking the uppermost page Ta. With this operation, the uppermost page Ta of the booklet T is lifted using a binding portion Tb of the booklet T as the center of rotation without changing the suction state to the vacuum pads 10*a*. The uppermost page Ta of the booklet T is lifted about the binding portion Tb of the booklet T without receiving any bending deformation force at all. Hence, the rigidity of the page does not influence the turning operation.

Figure 8:
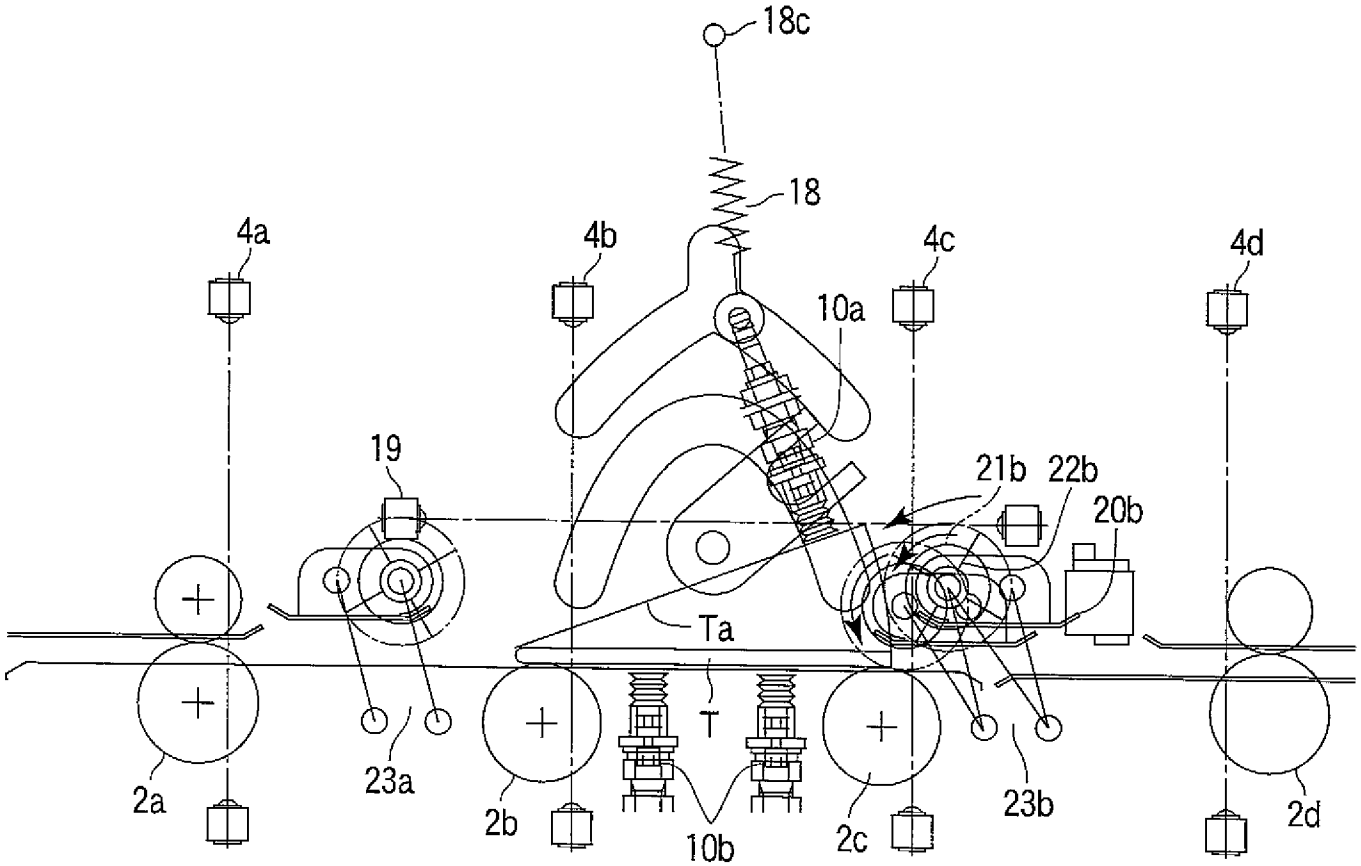
FIG. 8 is a view showing a state in which the pinch rollers enter under the uppermost page lifted by the vacuum pads in FIG. 7.

When the uppermost page Ta of the booklet T moves upward up to a predetermined position, the page lift detection sensor 19 detects it. Based on the detection, the control unit 40 moves the movable guide 20*b* from the standby position to the feed position together with the pinch rollers 21*b* and the impellers 22*b*, as shown in FIG. 8. At this time, the pages under the uppermost page Ta of the booklet T, which move upward together as the uppermost page is lifted, are beat down by the beating plates of the impellers 22*b*. The pinch rollers 21*b* enter to the lower surface side of the uppermost page Ta.

Figure 9:
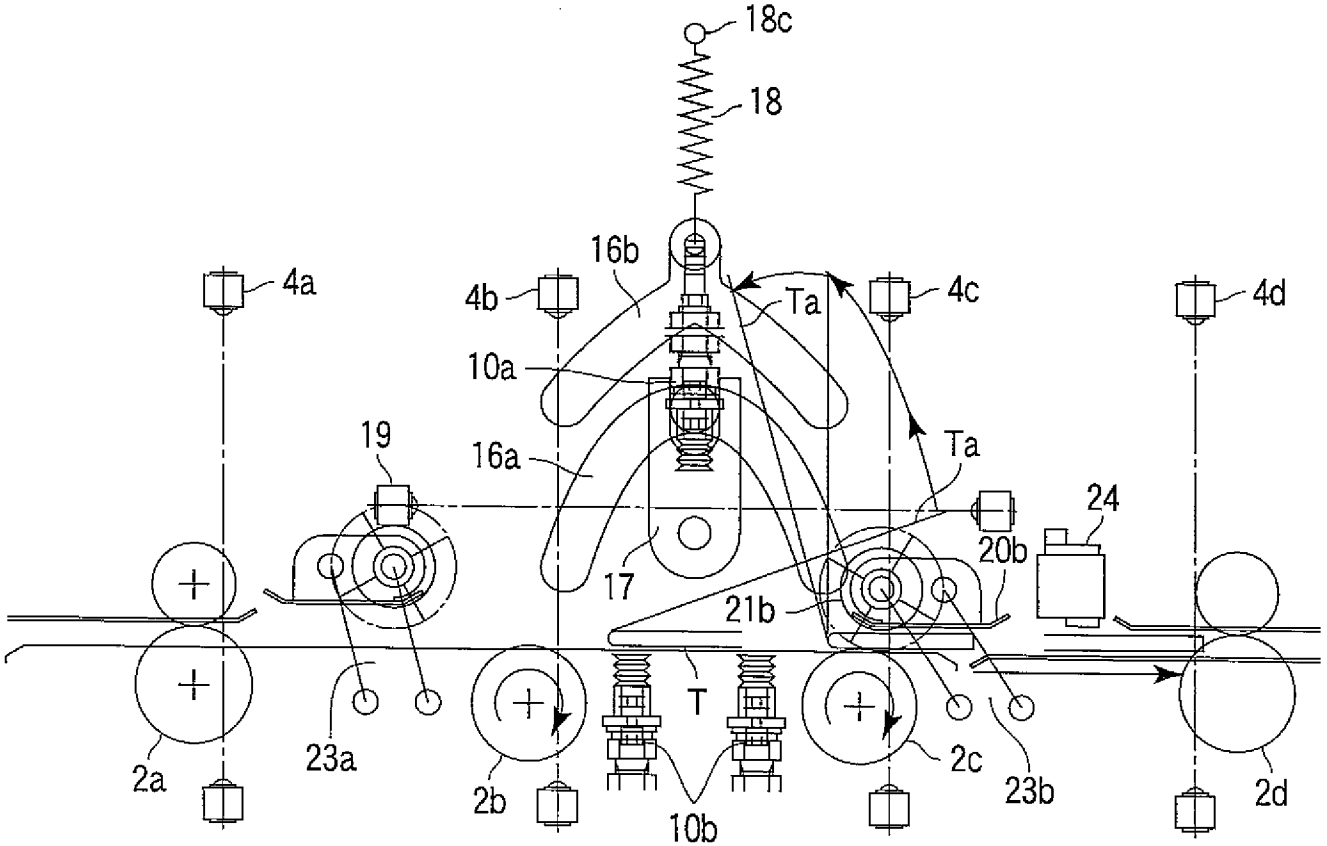
FIG. 9 is a view showing a state in which the booklet is fed from the state in which the pinch rollers have entered under the uppermost page in FIG. 8.

After that, the control unit 40 closes the control valve 13 and stops suction of the vacuum pads 10*a*. Next, the driving link plates 17 return to 12 o'clock, and the vacuum pads 10*a* return to the upper standby position, as shown in FIG. 9. After that, the feed roller 2*c* and the pinch rollers 21*b* rotate and feed the booklet T to the right side while sandwiching it. The booklet T is detected by the booklet detection sensor 4*d* and thus stops. This brings the uppermost page Ta of the booklet T into contact with the pinch rollers 21*b*.

Figure 10:
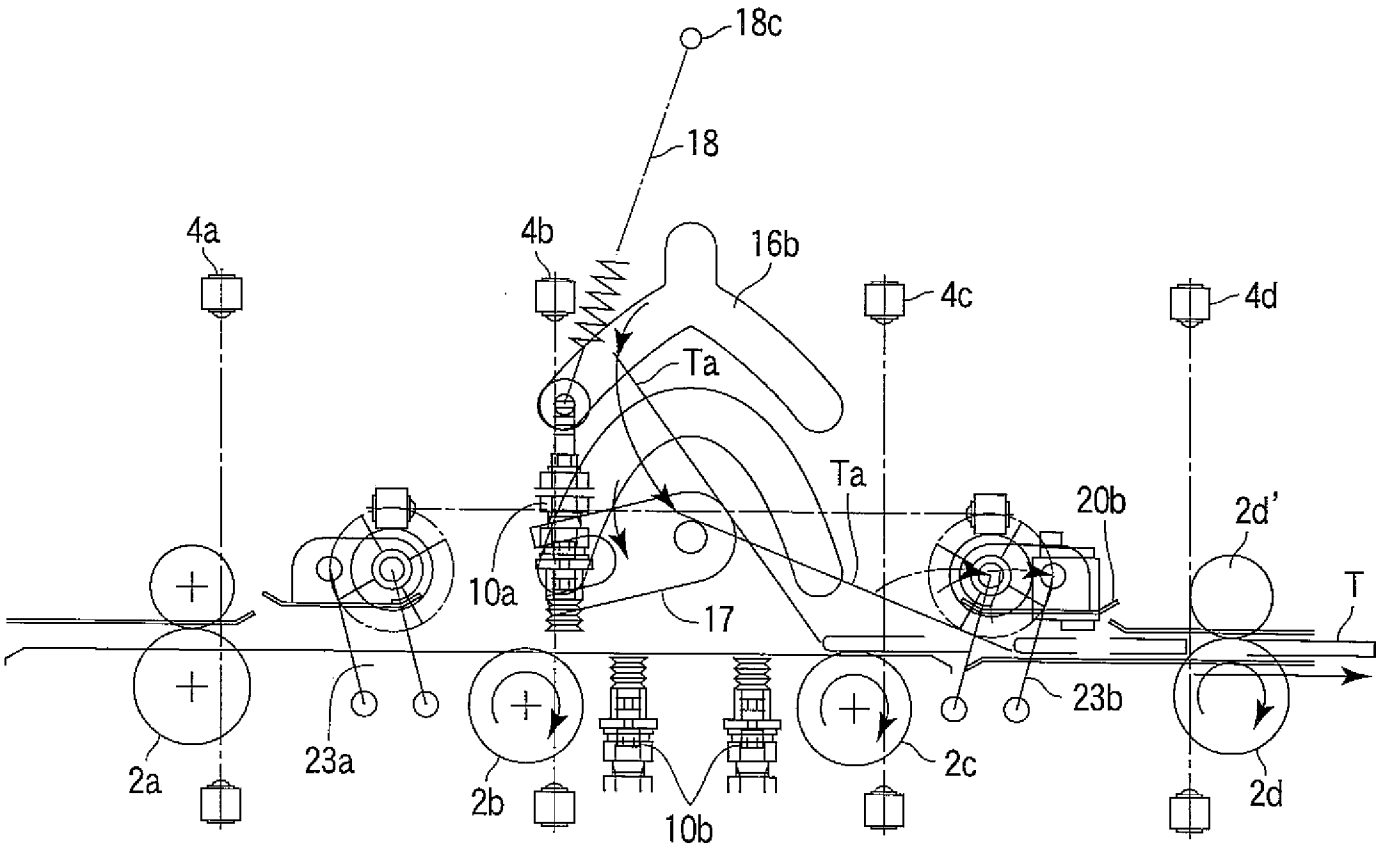
FIG. 10 is a view showing a state in which the uppermost page in contact with the pinch rollers is turned over as the booklet in FIG. 9 is fed.
Figure 11:
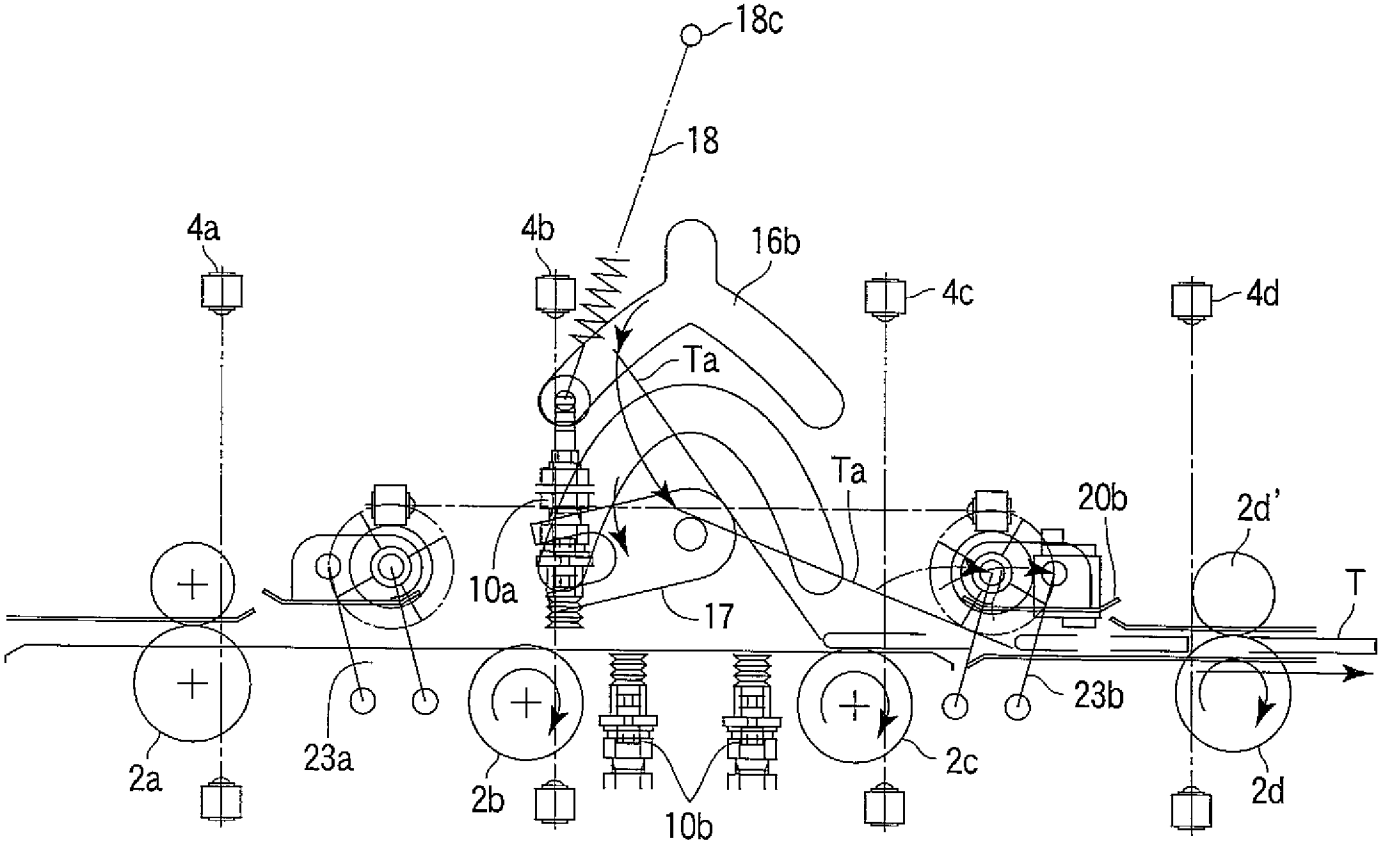
FIG. 11 is a view showing a state in which the uppermost page in FIG. 10 is completely turned over.

At this time, the driving link plates 17 in the initial state pivot counterclockwise to move the vacuum pads 10*a* so that they retreat from the turnover operation range of the uppermost page Ta of the booklet T, as shown in FIG. 10. The right edge of the booklet T is already sandwiched between the feed roller 2*d* and the pinch rollers 2*d*' and set in a feedable state. The movable guide 20*b* returns to the standby state. In this state, the feed roller 2*d* rotates to completely turn over the uppermost page Ta of the booklet T, as shown in FIG. 11, in a state in which no components to interfere exist in the neighborhood. In this case as well, the operation can be completed without depending on the rigidity of the page at all.

Note that during the feeding, the page number detection sensor 24 scans the page number printed on the opened page Ta of the booklet T. The scan information is sent to the control unit 40. The control unit 40 determines based on the received scan information whether the turning operation has been performed as programmed. Upon determining that the turning operation has not been performed as programmed, the turning operation is redone.

Figure 12:
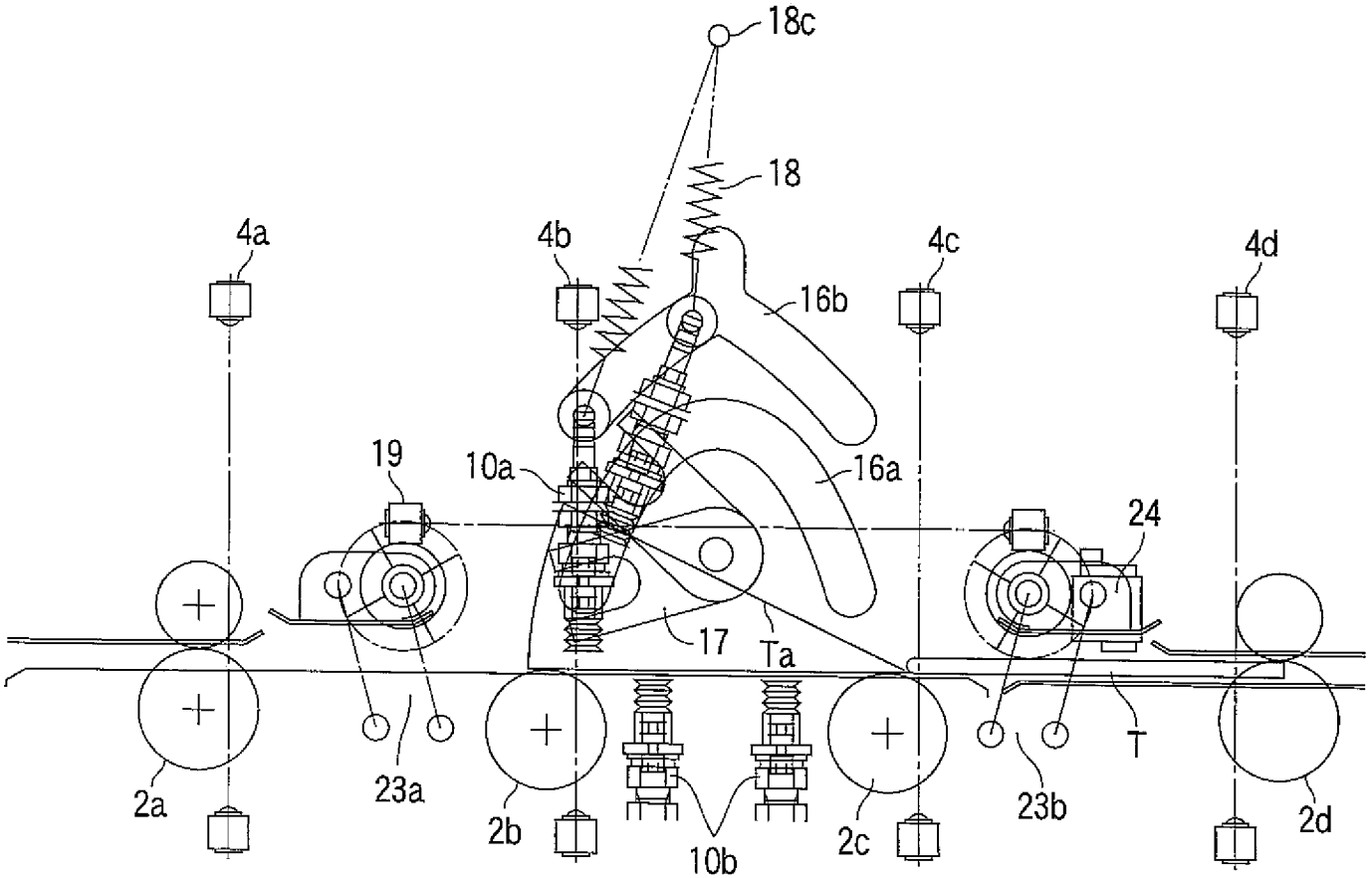
FIG. 12 is a view showing a state in which the uppermost page completely turned over in FIG. 11 is lifted by the vacuum pads in a reverse turning direction.
Figure 13:
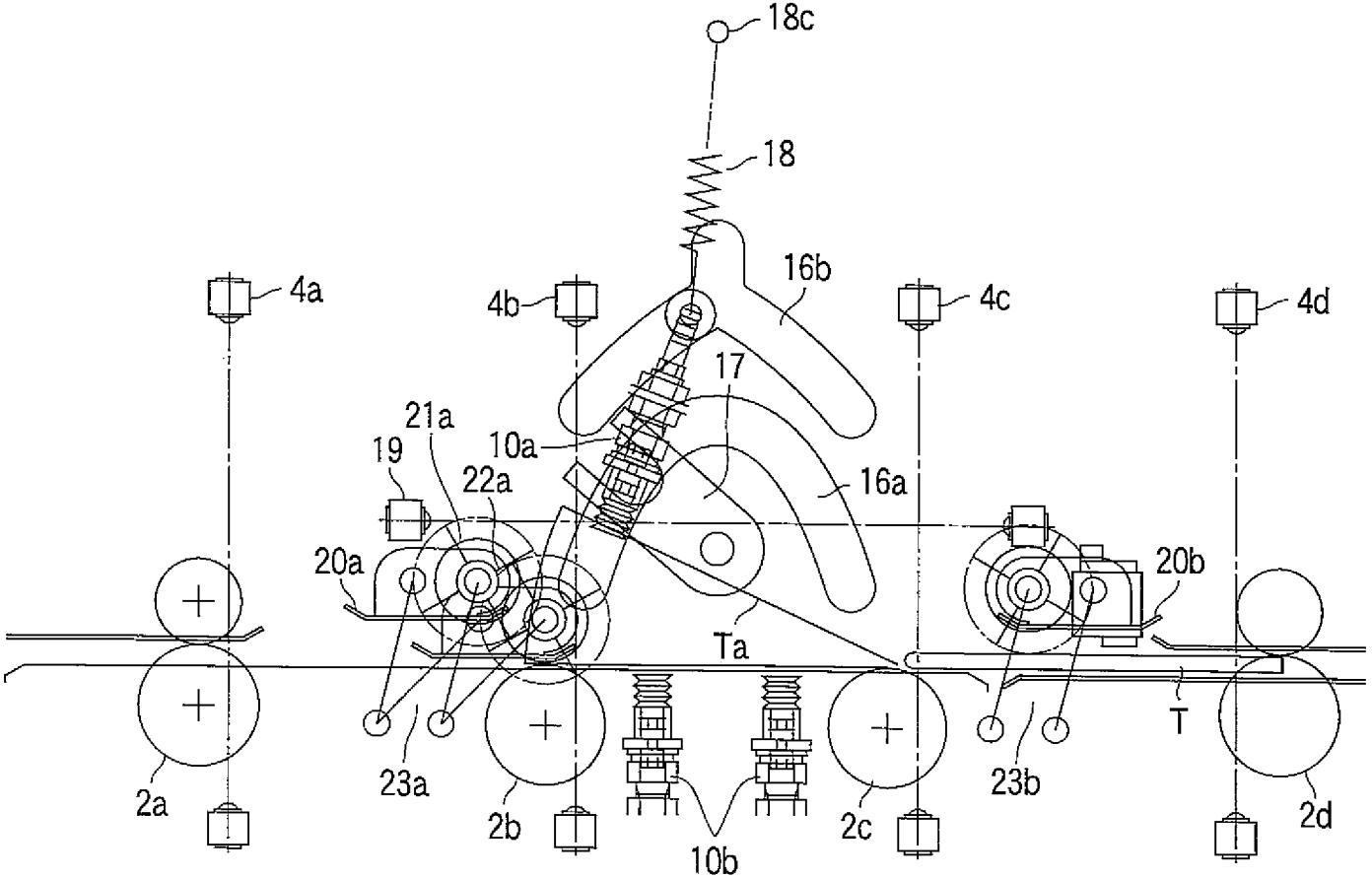
FIG. 13 is a view showing a state in which the pinch rollers enter under the uppermost page lifted in FIG. 12.
Figure 14:
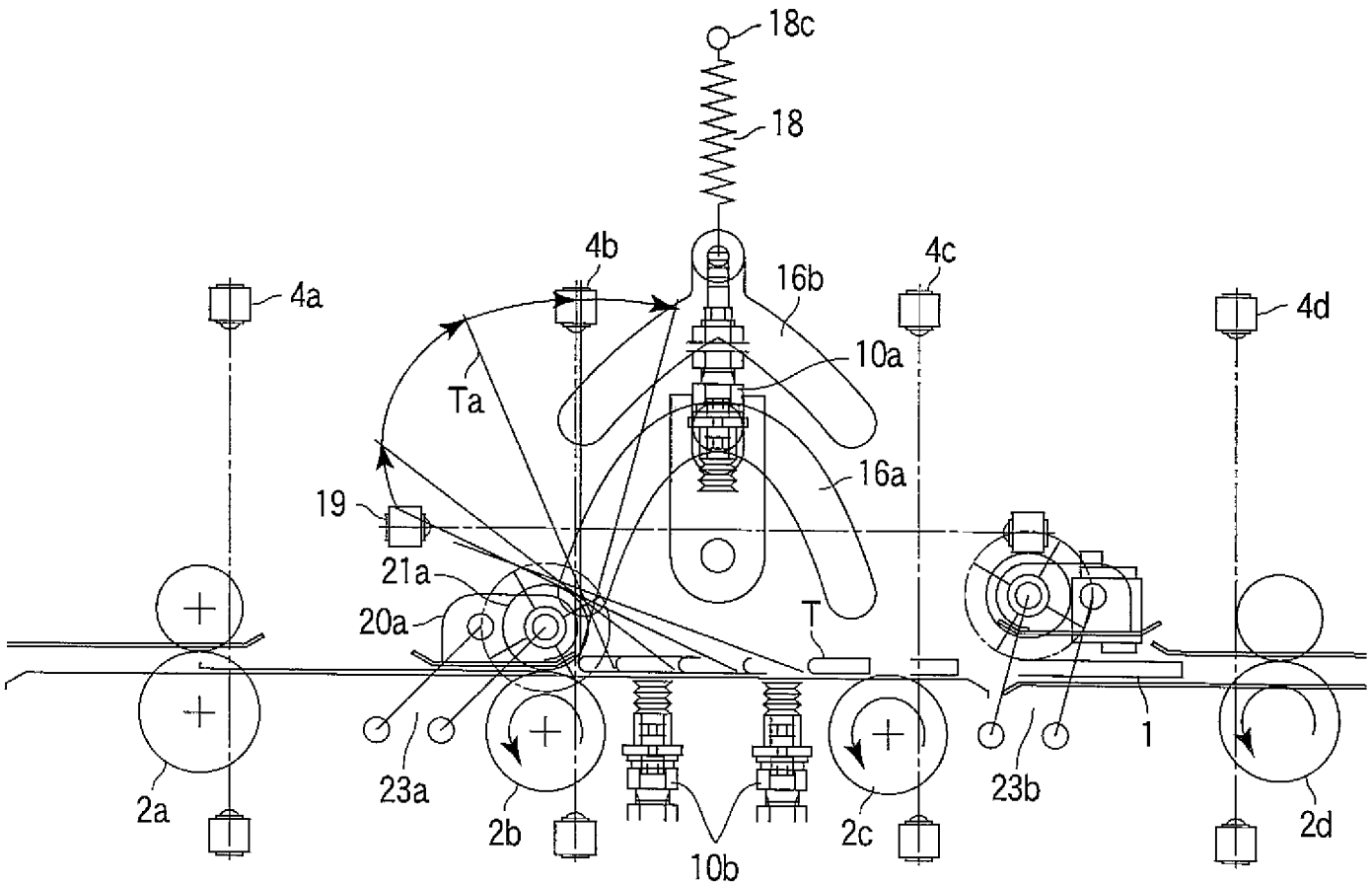
FIG. 14 is a view showing a state in which the uppermost page comes into contact with the pinch rollers that have entered under the uppermost page in FIG. 13.
Figure 15:
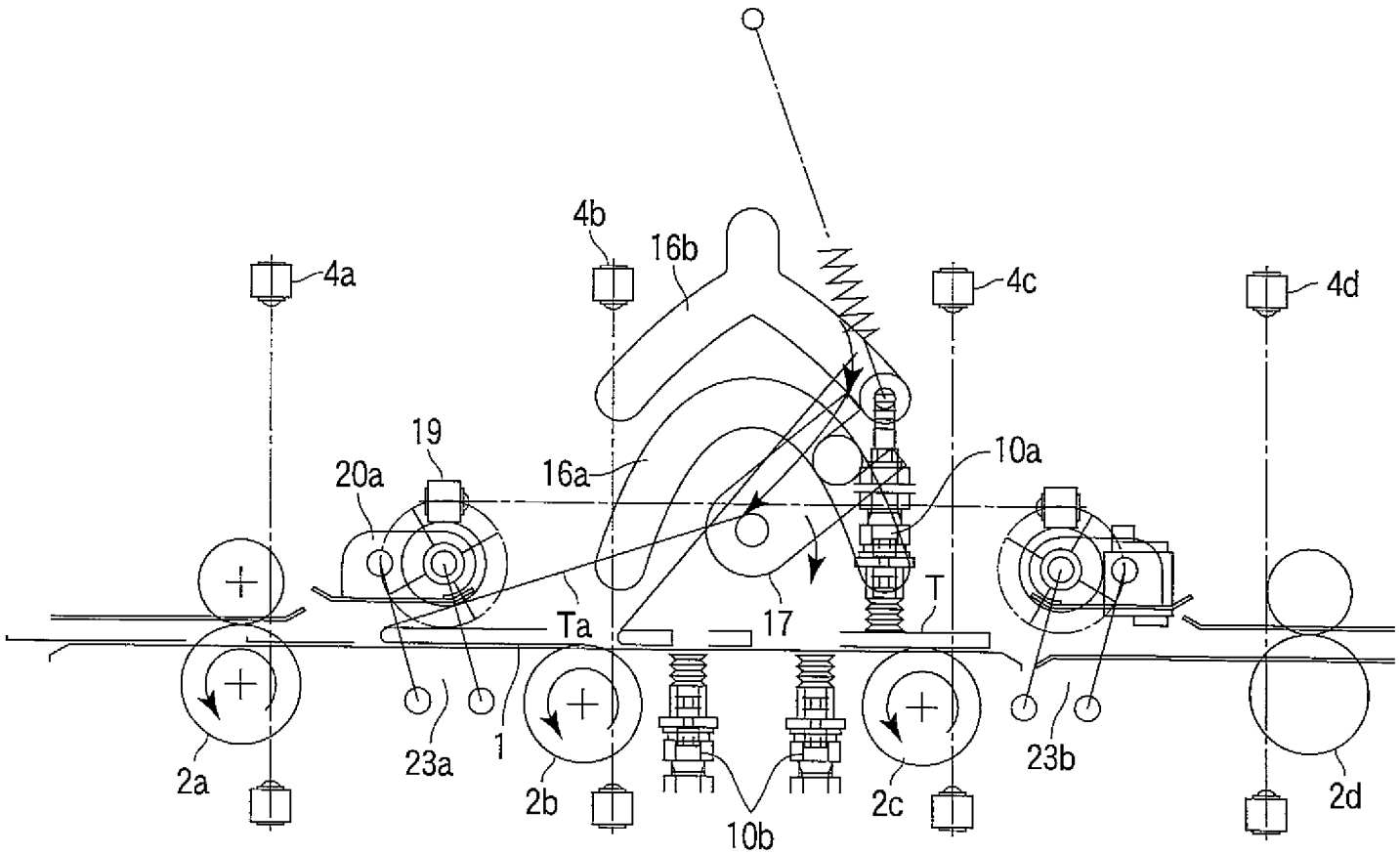
FIG. 15 is a view showing a state in which the uppermost page in contact with the pinch rollers in FIG. 14 largely pivots in the reverse turning direction.

Upon determining that the turning operation has been performed as programmed, the booklet T is fed to the post process and processed. After the process, the booklet T is fed backward and returned to the page turning position 5, as shown in FIG. 11. In this state, the vacuum pads 10*a* suck and lift the page Ta, as shown in FIG. 12. When the page lift detection sensor 19 detects the lifted page Ta, the movable guide 20*a* moves to the right side together with the pinch rollers 21*a* and the impellers 22*a* and enter to the lower surface side of the page Ta, as shown in FIG. 13. Then, as shown in FIG. 14, the feed rollers 2*b*, 2*c*, and 2*d* rotate in the directions of the arrows to feed the booklet T to the left side so that the page Ta comes into contact with the pinch rollers 21*a* and pivots in the closing direction. As the booklet T is further fed to the left side, as shown in FIG. 15, the page Ta pivots in the closing direction and closes, thus ending the page closing operation. During the page closing operation, the vacuum pads 10*a* retreat from the standby position to the lower right side not to come into contact with the page Ta that largely pivots in the closing direction.

Figure 16:
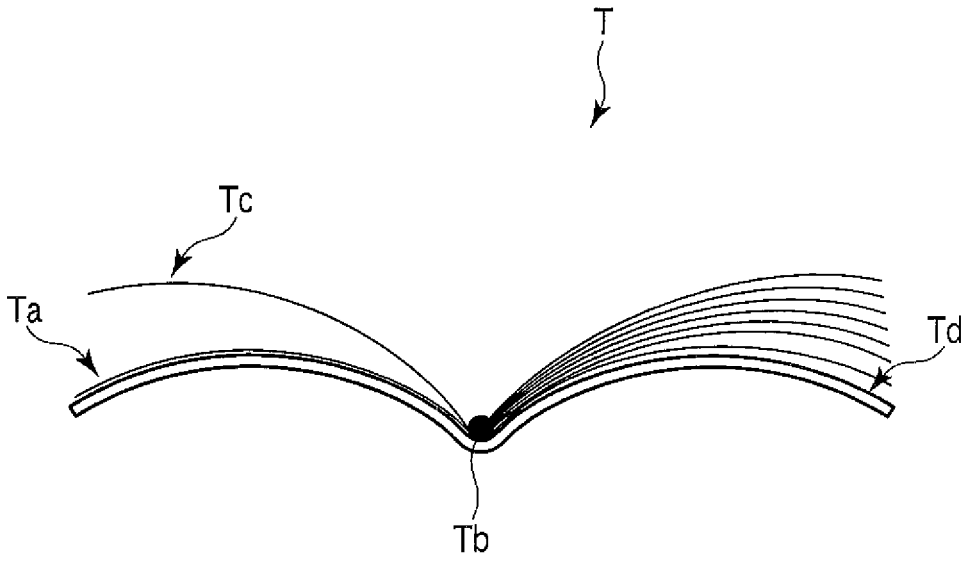
FIG. 16 is a view showing the structure of the booklet whose pages are turned by the page turning apparatus in FIG. 1.

The booklet T is formed from, e.g., the front cover Ta, inner sheets Tc, and a back cover Td, as shown in FIG. 16, and opened/closed about the binding portion Tb. A barcode is printed on the back cover Td.

Figure 18A:
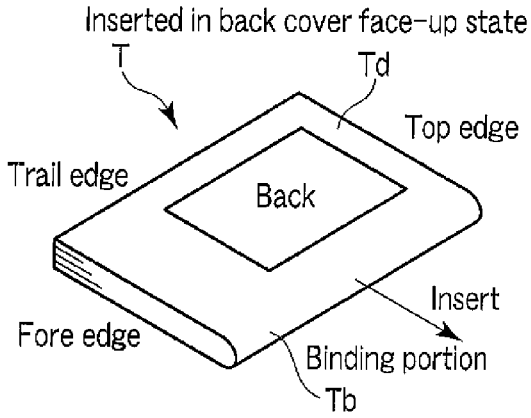
FIG. 18A is a perspective view showing a booklet inserted in a back cover face-up state.

The above-described page turning apparatus 1 includes a lifting mechanism 41 serving as a lifting device, as shown in FIG. 1. The lifting mechanism 41 lifts one page side of the opened booklet T above the pinch rollers 21*a* and folds the pages, as will be described later in detail. Even when the booklet T is inserted in a back cover face-up state and fed to the page turning position 5, as shown in FIG. 18A, the lifting mechanism 41 enables to invert the booklet T and turn the pages from the front cover side without requiring any special reversing mechanism.

The lifting mechanism 41 comprises the lifting arm 42. The proximal portion of the lifting arm 42 is connected to the arm driving motor 43 (shown in FIG. 5) serving as a pulse motor via a driving shaft 43*a*. The lifting arm 42 employs, as a distal end portion 42*a*, a member that produces little friction and can reduce the contact resistance such as a metal or resin shaft that does not rotate, or a metal or resin roller that rotates, thereby preventing damage to the pages of the booklet T.

The lifting arm 42 is designed to pivot by a predetermined angle (e.g., about 0° to 60°) in the vertical direction as the arm driving motor 43 rotates in the forward and backward directions. This pivotal motion moves the distal end portion 42*a* of the lifting arm 42 between the lower position (standby position) and the upper position. The distal end portion 42*a* can come into contact with the front cover side of the booklet T at the standby position and lift the pages at once.

A detection target piece 42*b* projects from the proximal portion of the lifting arm 42. First and second arm position detection sensors 45*a* and 45*b* are disposed near the detection target piece 42*b* along the pivoting direction. The first and second arm position detection sensors 45*a* and 45*b* are connected to the control unit 40, as shown in FIG. 5.

When the distal end portion 42*a* of the lifting arm 42 reaches the lower position (standby position), the first arm position detection sensor 45*a* detects the detection target piece 42*b*, and the driving of the arm driving motor 43 stops. When the distal end portion 42*a* of the lifting arm 42 reaches the upper position, the second arm position detection sensor 45*b* detects the detection target piece 42*b*, and the driving of the arm driving motor 43 stops.

The contact feed mechanism 20A includes a first guide plate 46*a* serving as a first guide unit configured to receive the pages on the front cover side of the booklet T which are lifted by the lifting arm 42 and then drop off from the lifting arm 42, as will be described later. The support carriage 15 of the vacuum pads 10*a* includes a second guide plate 47*a* serving as a second guide unit configured to receive the pages on the front cover side of the booklet T which are folded, as will be described later. The first and second guide plates 46*a* and 47*a* are made of a metal or resin material not to damage the pages of the booklet T.

The booklet T is inserted and fed to the page turning position 5 in various states.

Figure 17A:
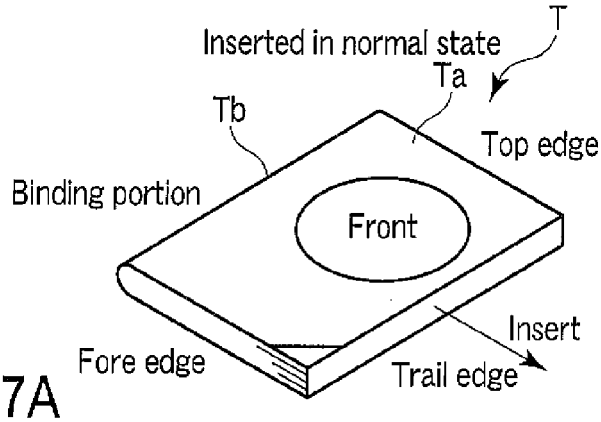
FIG. 17A is a perspective view showing a booklet inserted in a normal state.

For example, the booklet T is inserted in a state (normal state) with the binding portion Tb facing left and the front cover Ta facing up, as shown in FIG. 17A, or in a state (back cover face-up state) with the binding portion Tb facing right and the back cover Td facing up, as shown in FIG. 18A. The page turning apparatus 1 needs to perform the page turning operation in accordance with the inserted state of the booklet T.

FIGS. 17A to 17D illustrate processing of the booklet T inserted in a normal state.

Figure 17B:
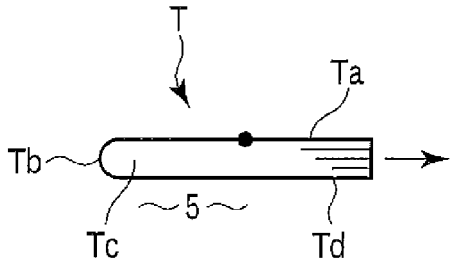
FIG. 17B is a view showing a state in which the booklet in FIG. 17A is fed to the turning position.
Figure 17C:
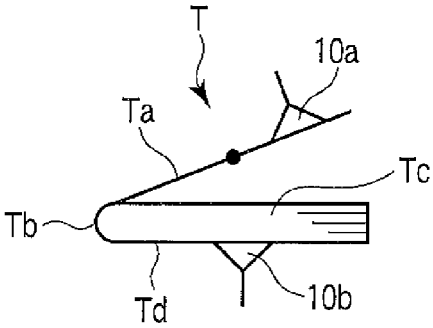
FIG. 17C is a view showing a state in which the front cover of the booklet in FIG. 17B is turned up.
Figure 17D:
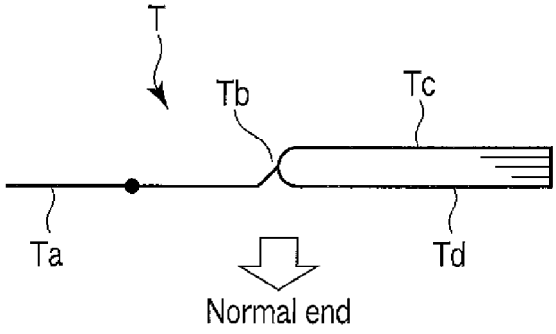
FIG. 17D is a view showing a state in which the front cover of the booklet in FIG. 17C is open.

When the booklet T is inserted, as shown in FIG. 17A, and reaches the page turning position 5, as shown in FIG. 17B, the vacuum pads 10*a* perform a left turning operation at the page turning position 5, as shown in FIG. 17C, to open the front cover Ta, as shown in FIG. 17D. The print surface Tc is opened in the same way and printed, and the booklet T is then discharged.

FIGS. 18A to 22B illustrate processing of the booklet T inserted in a back cover face-up state. FIG. 23 is a flowchart of the processing.

Figure 18B:
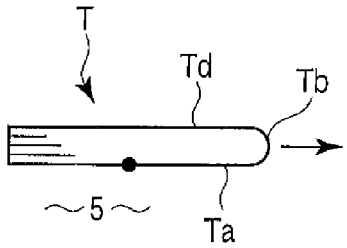
FIG. 18B is a view showing a state in which the booklet in FIG. 18A is fed to the turning position.
Figure 18C:
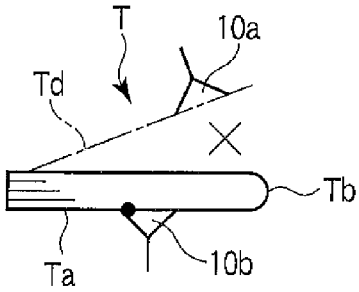
FIG. 18C is a view showing a state in which the back cover of the booklet in FIG. 18B cannot be turned up.

The booklet T is inserted and fed in a closed state, as shown in FIG. 18A (step ST1 of FIG. 23). When the booklet T reaches the page turning position 5, as shown in FIG. 18B, the vacuum pads 10*a* perform left turning as in the normally inserted state, as shown in FIG. 18C. However, since the vacuum pads 10*a* are going to suck and lift the side of the binding portion Tb, the upper vacuum pads 10*a* and the lower vacuum pads 10*b* pull against each other.

The plurality of vacuum pads 10*a* and 10*b* hold a relation given by $$\Sigma spfp < \Sigma SqFq$$

s and S: the distances between the axis of the lifting operation and the vacuum pads f and F: the suction forces of the vacuum pads Note that the lowercase letters indicate upper vacuum pads, and the uppercase letters indicate lower vacuum pads.

The upper vacuum pads exist from 1 to p, and the lower vacuum pads exist from 1 to q.

With this relation, when the upper vacuum pads 10*a* and the lower vacuum pads 10*b* pull against each other, the upper vacuum pads 10*a* always release the booklet T.

Figure 18D:
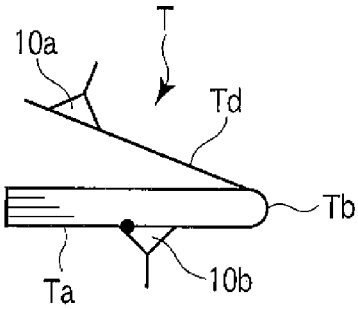
FIG. 18D is a view showing a state in which the back cover of the booklet in FIG. 18C is turned up.
Figure 18E:
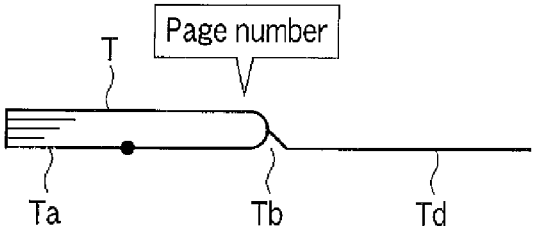
FIG. 18E is a view showing a state in which the back cover of the booklet in FIG. 18D is open.

In this case, the control unit 40 determines that the binding portion Tb of the inserted booklet T is located on the right side. Hence, a right turning operation is performed, as shown in FIG. 18D, to open the back cover Td, as shown in FIG. 18E (step ST2). Then, the booklet T is fed to an OCR unit (not shown) (step ST3) to read the barcode (step ST4).

Figure 19A:
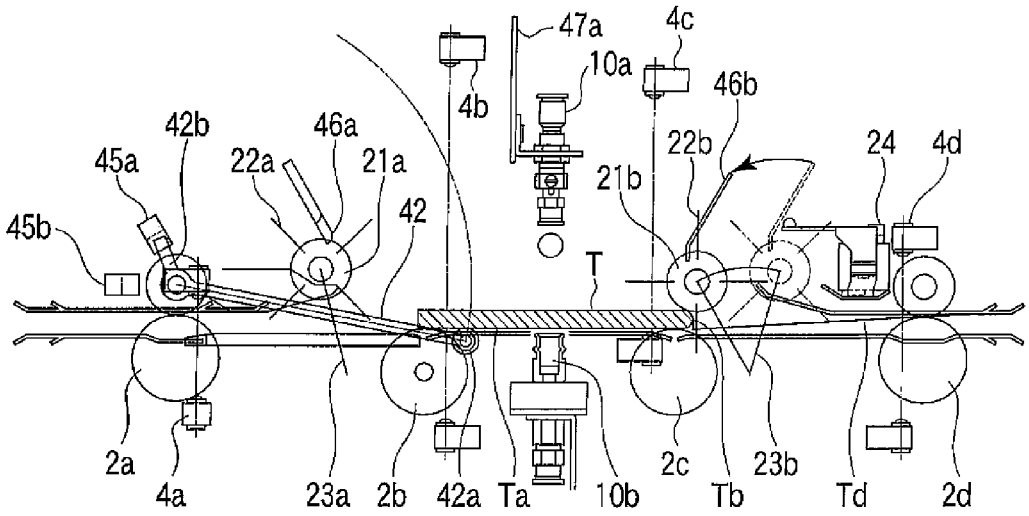
FIG. 19A is a view showing a state in which the pages on the front cover side of the booklet in FIG. 18E are fed to the turning position.
Figure 19B:
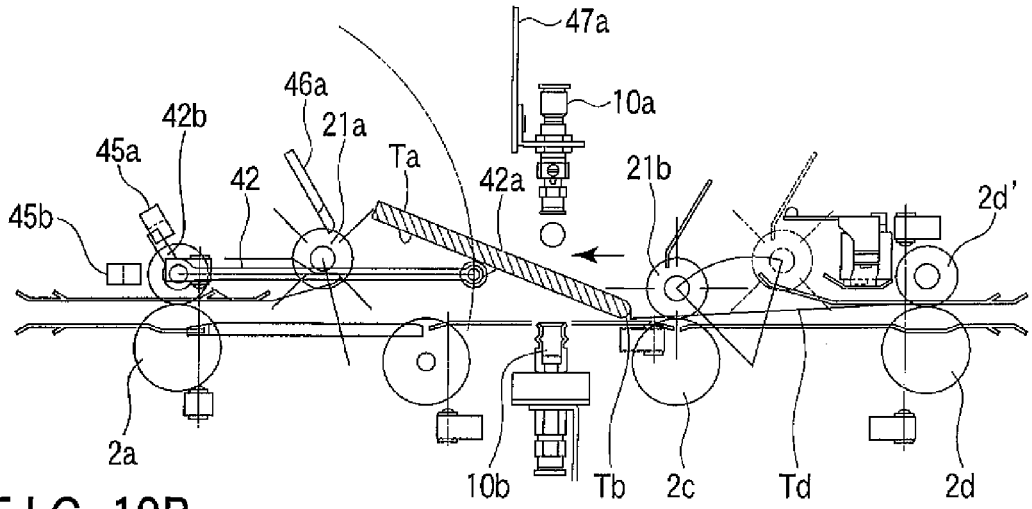
FIG. 19B is a view showing a state in which the pages on the front cover side of the booklet in FIG. 19A are lifted at once.

After the reading, the booklet T is fed to locate the pages on the side of the front cover Ta at the page turning position 5, as shown in FIG. 19A (step ST5) and bring the front cover into contact with the distal end portion 42*a* of the lifting arm 42. The arm driving motor 43 is driven to make the lifting arm 42 pivot upward, as shown in FIG. 19B. The distal end portion 42*a* lifts the side of the front cover Ta of the booklet T. At the same time, the feed rollers 2*c* and 2*d* rotate to feed the booklet T to the left side, as indicated by the arrow.

Figure 19C:
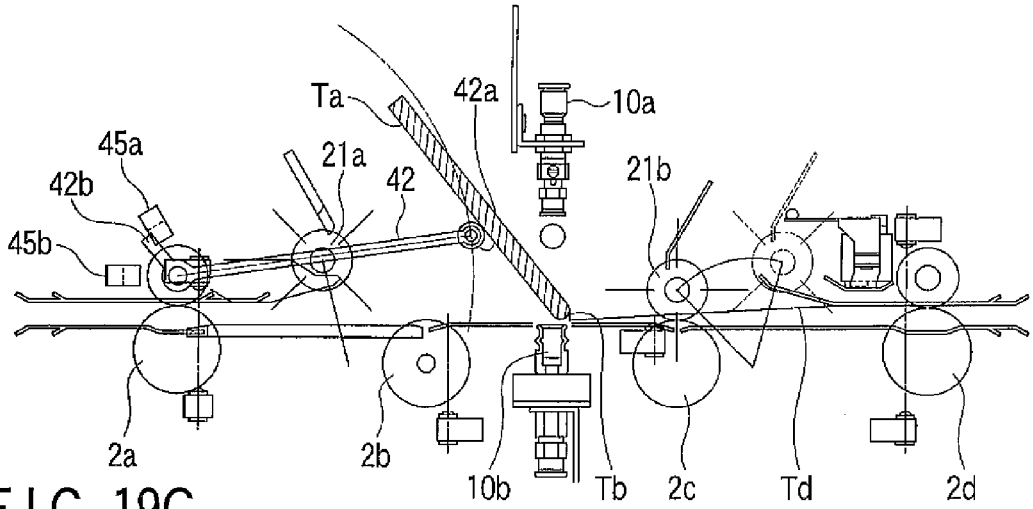
FIG. 19C is a view showing a state in which the pages on the front cover side of the booklet in FIG. 19B are further lifted.
Figure 20A:
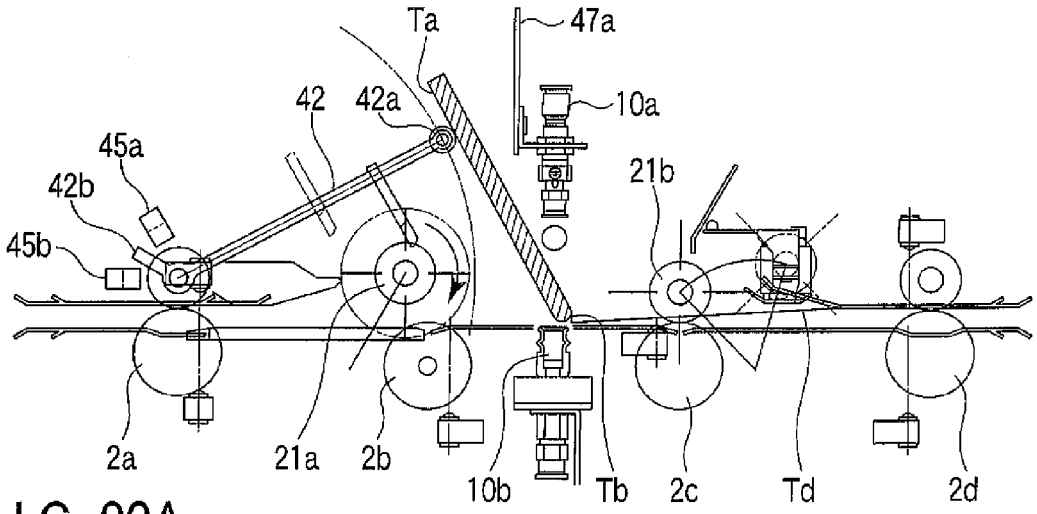
FIG. 20A is a view showing a state in which the pages on the front cover side of the booklet in FIG. 19C are further lifted.
Figure 20B:
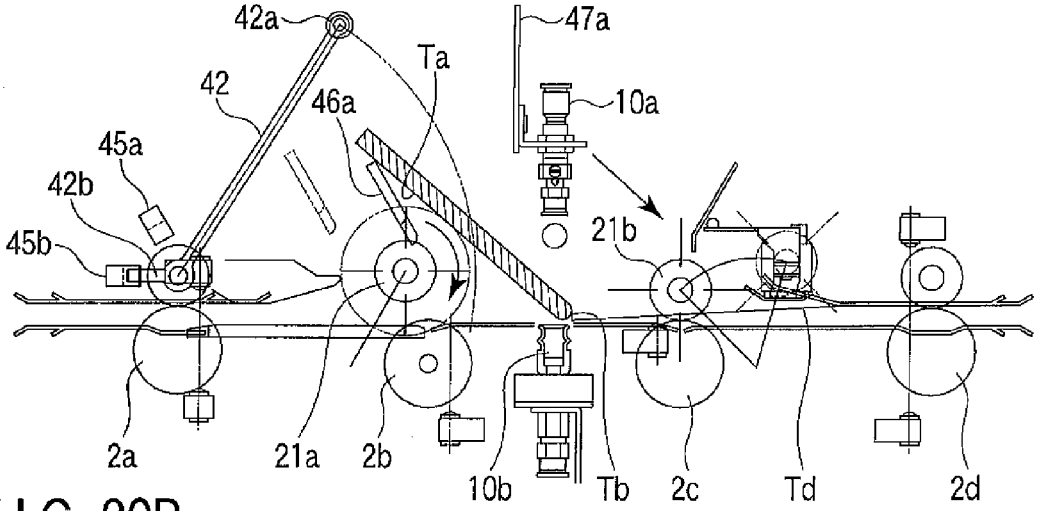
FIG. 20B is a view showing a state in which the pages on the front cover side of the booklet in FIG. 20A drop off from a lifting arm.

Upon this feed, the binding portion Tb of the booklet T passes between the feed roller 2*c* and the pinch rollers 21*b*, and the pages on the side of the front cover Ta of the booklet T are lifted upward at once about the binding portion Tb, as shown in FIG. 19C. The lifting arm 42 further pivots upward from this state to lift the pages on the side of the front cover Ta, as shown in FIG. 20A. Finally, the pages on the side of the front cover Ta are released from the distal end portion 42*a* of the lifting arm 42, as shown in FIG. 20B.

Upon the release, the pages on the side of the front cover Ta of the booklet T lose the support and drop, come into contact with the first guide plate 46*a* so as to be held by it. At this time, the second arm position detection sensor 45*b* detects the detection target piece 42*b* of the lifting arm 42, and the upward pivotal motion of the lifting arm 42 stops.

Figure 20C:
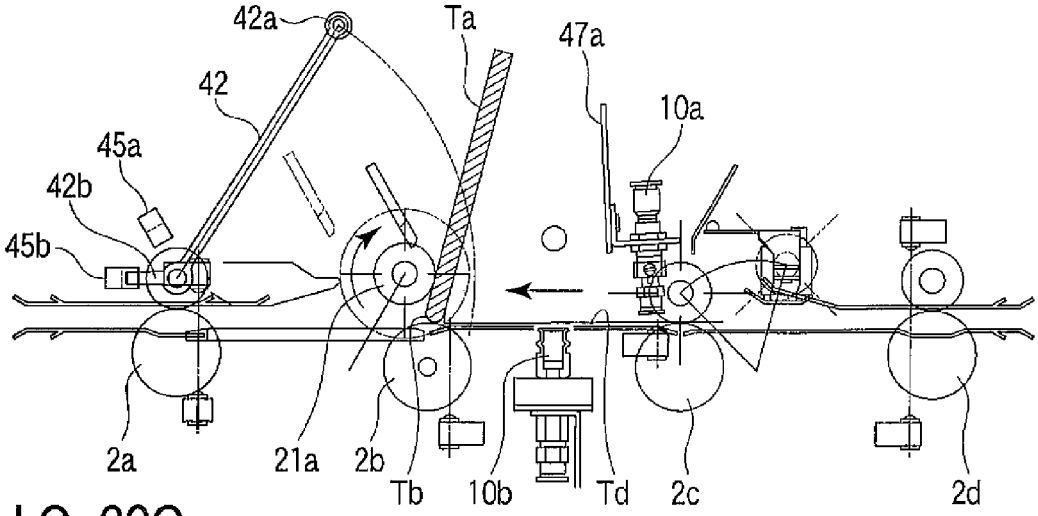
FIG. 20C is a view showing a state in which the pages on the front cover side of the booklet in FIG. 20B are folded.
Figure 21A:
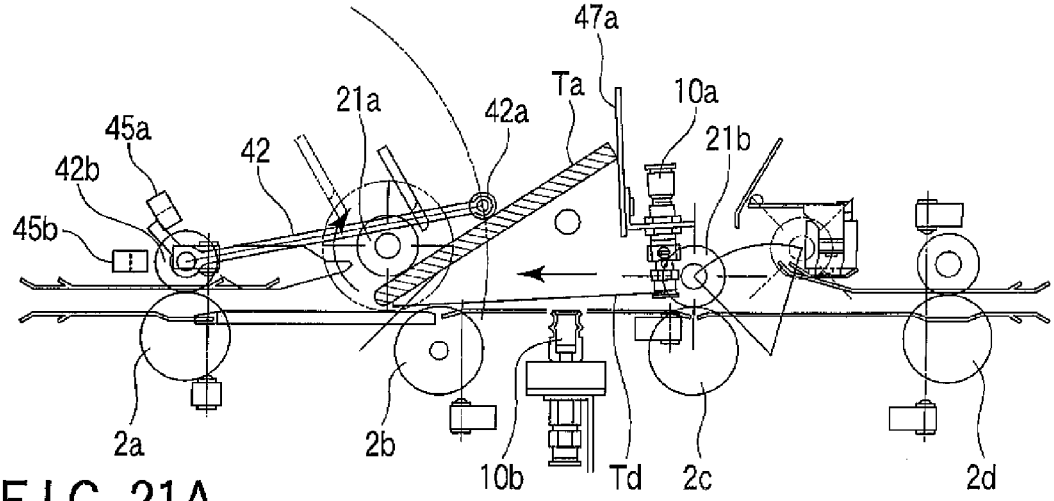
FIG. 21A is a view showing a state in which the pages on the front cover side of the booklet in FIG. 20C are folded while being pushed down by the lifting arm.
Figure 21B:
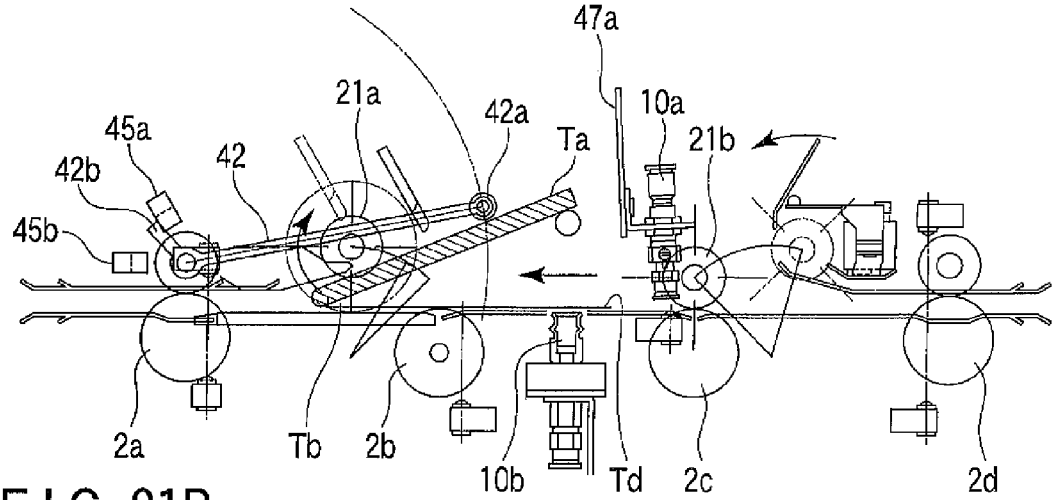
FIG. 21B is a view showing a state in which the pages on the front cover side of the booklet in FIG. 21A are folded while being further pushed down.
Figure 21C:
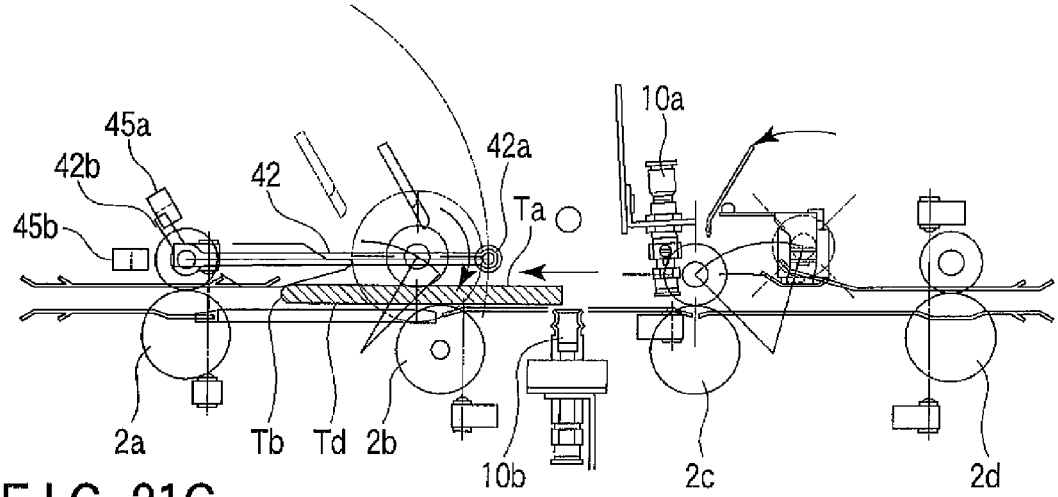
FIG. 21C is a view showing a state in which the pages on the front cover side of the booklet in FIG. 21B are completely folded.

From this state, the booklet T is further fed to the left side, as indicated by the arrow in FIG. 20C so that the lower side of the pages under the front cover Ta comes into contact with the pinch rollers 21*a*. At this time, the vacuum pads 10*a* retreat to the lower right side to avoid interference with the pages on the side of the front cover Ta of the booklet T. After that, the booklet T is further fed to the left side, as indicated by the arrow in FIG. 21A. The pages under the front cover Ta are introduced between the feed roller 2*b* and the pinch rollers 21*a* and folded. At this time, the pages on the side of the front cover Ta come into contact with the second guide plate 47*a* so as to be guided. Simultaneously, the lifting arm 42 pivots downward so that the distal end portion 42*a* pushes the pages on the side of the front cover Ta of the booklet down to assist the folding operation. The booklet T is then further fed in the direction of the arrow, as shown in FIG. 21B, and fed between the feed roller 2*b* and the pinch rollers 21*a* to fold the pages on the side of the front cover Ta, as shown in FIG. 21C (step ST6).

Figure 22A:
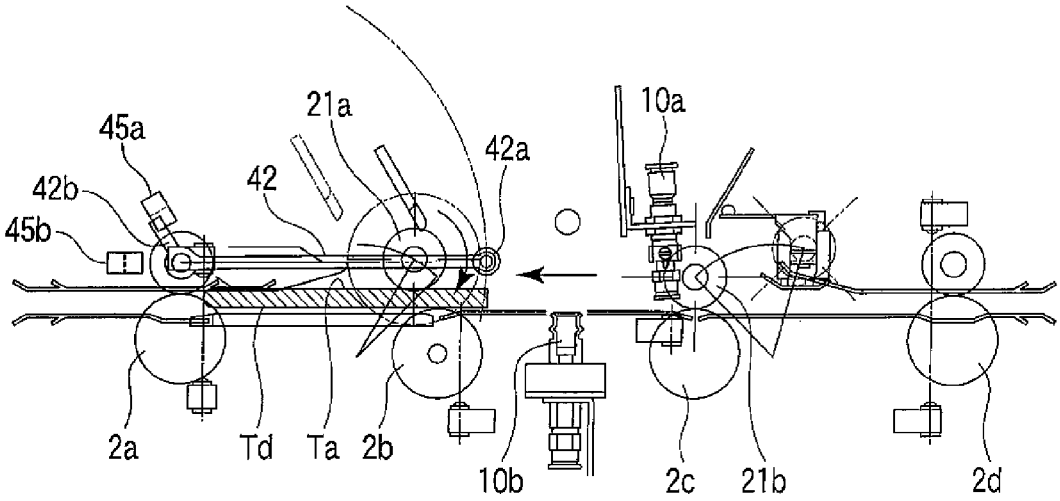
FIG. 22A is a view showing a state in which the booklet in FIG. 21C has passed the distal end portion of the lifting arm.
Figure 22B:
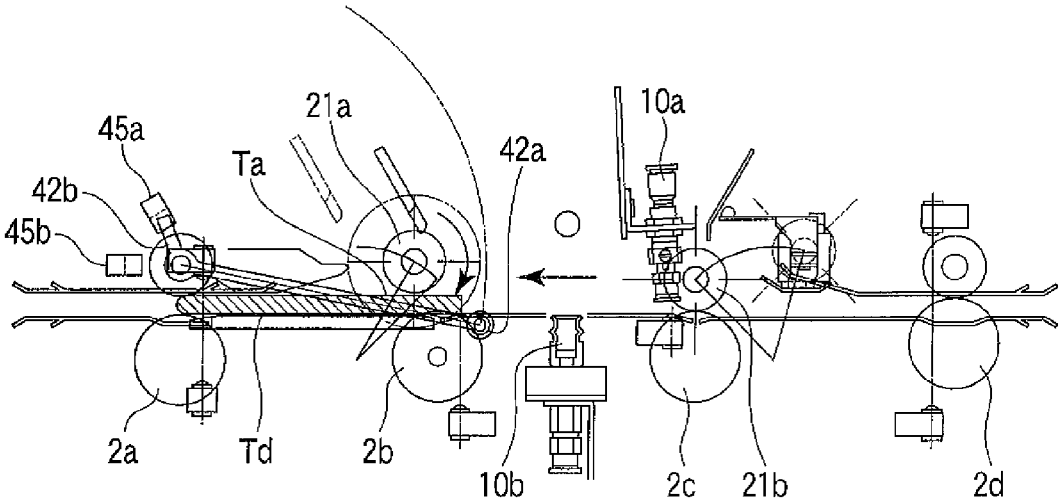
FIG. 22B is a view showing a state in which the lifting arm in FIG. 22A moves down to the initial position.
Figure 23:
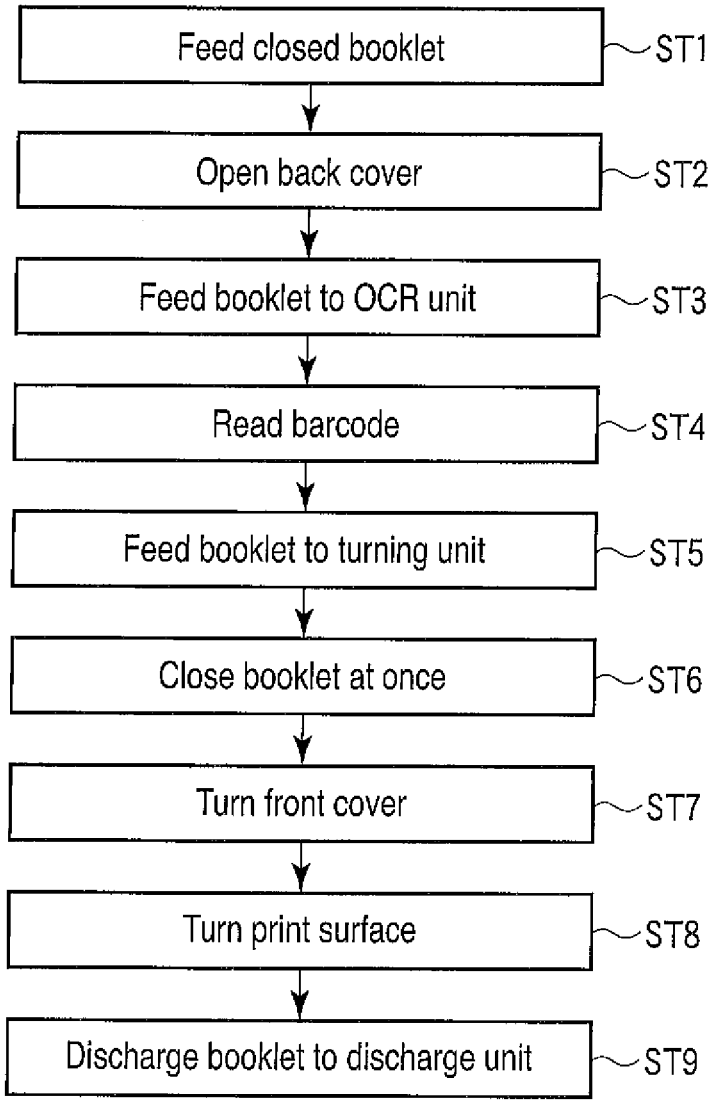
FIG. 23 is a flowchart illustrating an operation of processing a booklet inserted in the back cover face-up state.

The folded booklet T is further fed in the direction of the arrow, as shown in FIG. 22A. When the trailing edge in the feed direction passes through the distal end portion of the lifting arm 42, as shown in FIG. 22B, the lifting arm 42 further pivots downward and returns to the standby position.

The booklet T thus folded has the same state as the normally inserted state shown in FIG. 17A described above. As described with reference to FIGS. 17B to 17D, the folded booklet T is fed to the page turning position 5, as shown in FIG. 17B. The vacuum pads 10*a* perform the left turning operation at the page turning position 5, as shown in FIG. 17C. The front cover Ta is turned, as shown in FIG. 17D (step ST7 of FIG. 23). The print surface Tc is turned (step ST8) and printed, and the booklet T is then discharged (step ST9).

As described above, according to the first embodiment, if the booklet T is inserted and fed to the page turning position 5 in the back cover face-up state, the back cover Td of the booklet T is opened. After that, the lifting arm 42 lifts the pages on the side of the front cover Ta at once about the binding portion Tb and folds the pages.

It is therefore possible to lift and fold the pages at once even in a booklet having a page with high flexural rigidity as a part of adding values, for example, a booklet that includes an ID page with a security protection layer to prevent forgery and alteration of personal information, a booklet that has a plastic sheet-like page incorporating an IC chip to allow high-density recording, or a booklet that has a wireless IC chip so as to enable noncontact information read/write, not to mention a soft booklet T.

Second Embodiment

FIGS. 24A to 27B show a page turning apparatus according to the second embodiment of the present invention.

Note that the same reference numerals as in the above-described first embodiment denote the same parts, and a detailed description thereof will not be repeated.

In the above-described first embodiment, only one lifting arm 42 is provided. In the second embodiment, in addition to a first lifting arm 42, a second lifting arm 52 is disposed to be symmetric with respect to the first lifting arm 42 about a page turning position 5. The second lifting arm 52 has the same structure as the first lifting arm 42, and a detailed description thereof will not be repeated.

According to the second embodiment, a booklet T inserted in the back cover face-up state is lifted and closed by the first lifting arm 42*a* so that page turning processing can be performed from the front cover side, as in the first embodiment. In addition, when the booklet T is inserted in the normal state, the pages on the side of a back cover Td are lifted and folded at once to enable page turning from the back cover side.

The operation of folding the pages on the side of the back cover Td of the booklet T inserted in the normal state will be explained next.

Figure 24A:
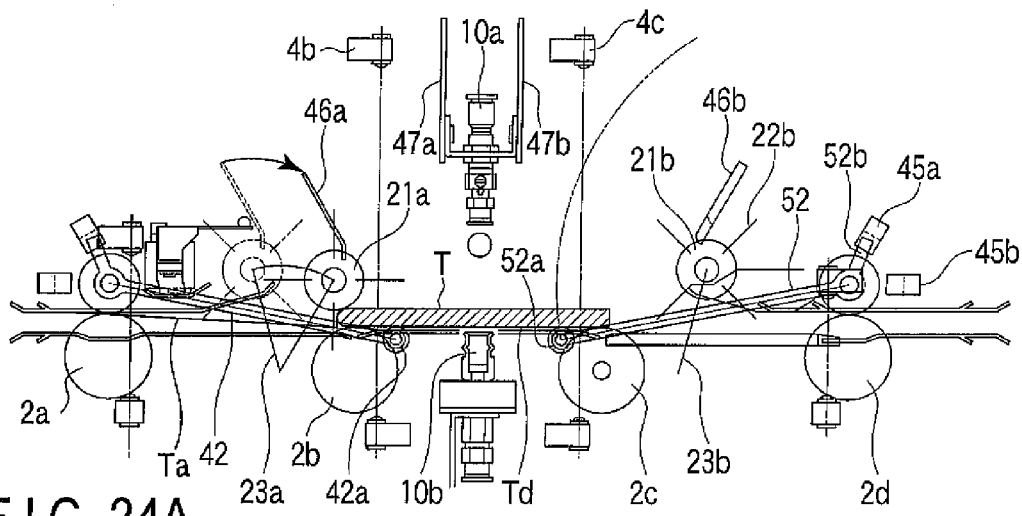
FIG. 24A is a view showing a state in which the front cover of a booklet inserted in a normal state is opened, and the pages on the back cover side of the booklet are fed to the turning position in a page turning apparatus according to the second embodiment of the present invention.
Figure 24B:
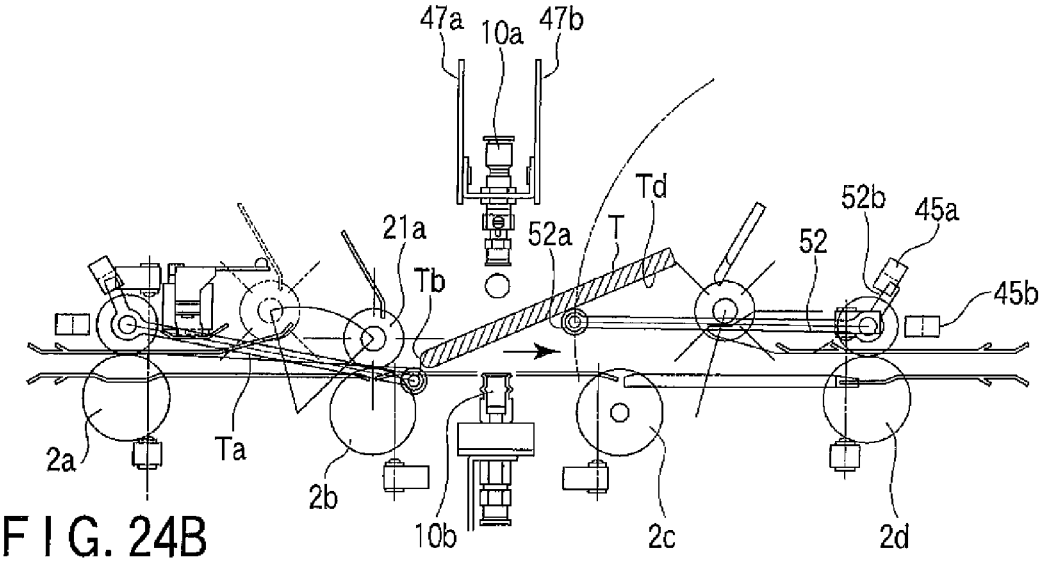
FIG. 24B is a view showing a state in which the pages on the back cover side of the booklet in FIG. 24A are lifted at once.
Figure 24C:
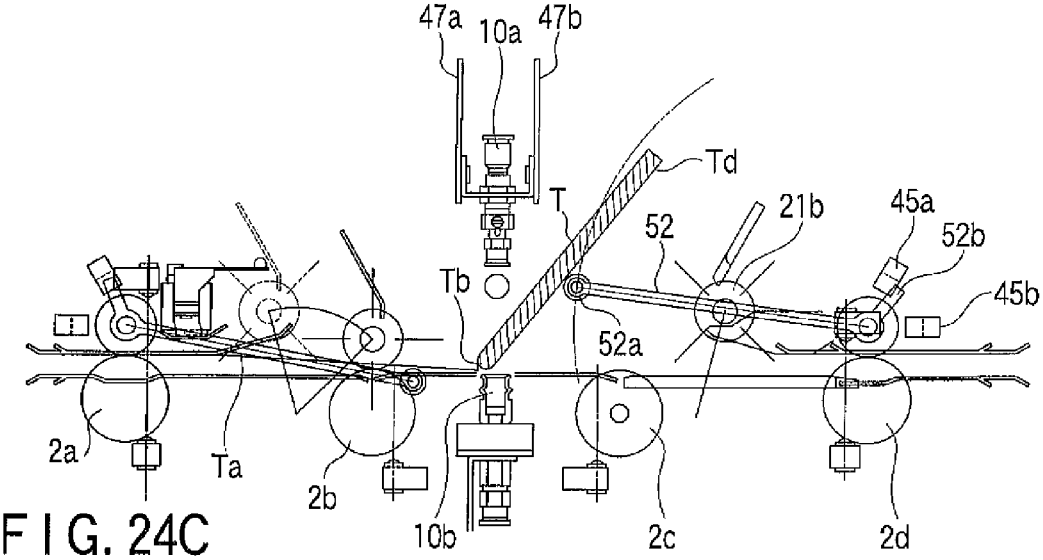
FIG. 24C is a view showing a state in which the pages on the back cover side of the booklet in FIG. 24B are further lifted.
Figure 25A:
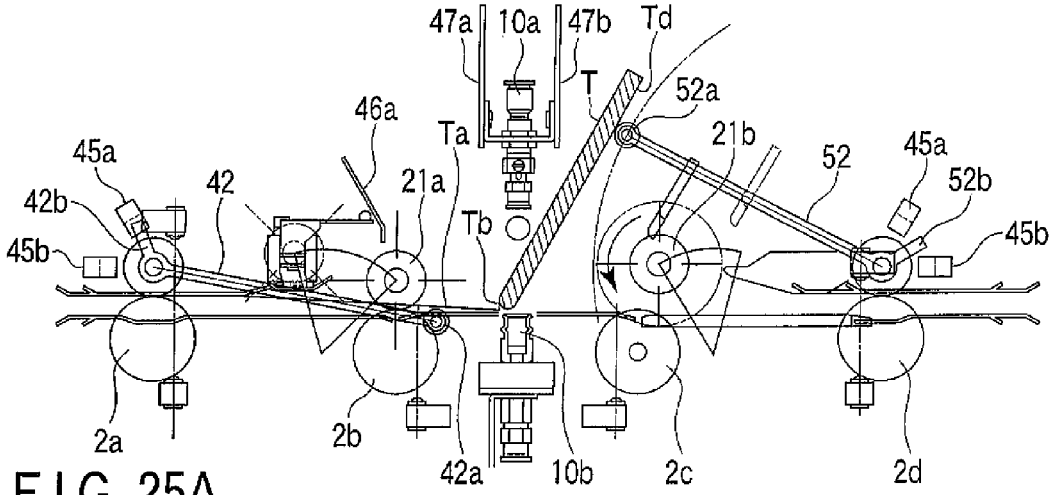
FIG. 25A is a view showing a state in which the pages on the back cover side of the booklet in FIG. 24C are further lifted.
Figure 25B:
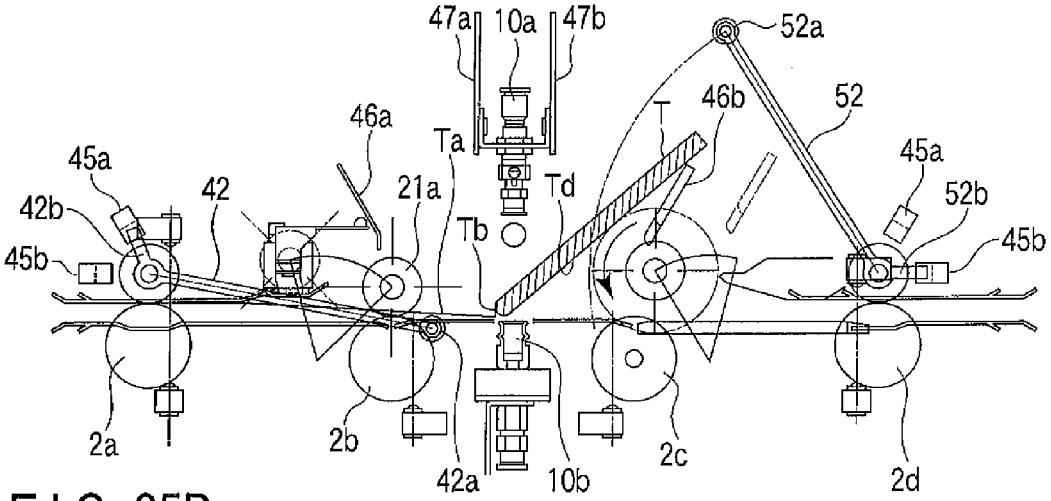
FIG. 25B is a view showing a state in which the pages on the back cover side of the booklet in FIG. 25A drop off from a lifting arm.

When the booklet T is closed, inserted, and fed in the normal state, as shown in FIG. 17A, and reaches the page turning position 5, as shown in FIG. 17B, vacuum pads 10*a* perform a left turning operation at the page turning position 5, as shown in FIG. 17C, to open the front cover Ta, as shown in FIG. 17D. The booklet T is then fed so that the pages on the side of the back cover Td are fed to the page turning position 5 so as to come into contact with a distal end portion 52*a* of the second lifting arm 52, as shown in FIG. 24A. After that, an arm driving motor (not shown) is driven to make the second lifting arm 52 pivot upward, as shown in FIG. 24B, so that the distal end portion 52*a* lifts the pages on the side of the back cover Td of the booklet T. Simultaneously, a feed roller 2*b* and pinch rollers 21*a* feed the booklet T to the right side, as indicated by the arrow. Upon this feed, a binding portion Tb of the booklet T passes between the feed roller 2*b* and the pinch rollers 21*a*, and the pages on the side of the back cover Td of the booklet T are lifted upward at once about the binding portion Tb, as shown in FIG. 24C. The second lifting arm 52 further pivots upward from this state to lift the pages on the side of the back cover Td of the booklet T, as shown in FIG. 25A. Finally, the pages on the side of the back cover Td of the booklet T are released from the distal end portion 52*a* of the lifting arm 52, as shown in FIG. 25B. Upon the release, the pages on the side of the back cover Td of the booklet T lose the support and drop, come into contact with a first guide plate 46*b* so as to be held by it. At this time, a second arm position detection sensor 45*b* detects a detection target piece 52*b* of the lifting arm 52, and the upward pivotal motion of the lifting arm 52 stops.

Figure 25C:
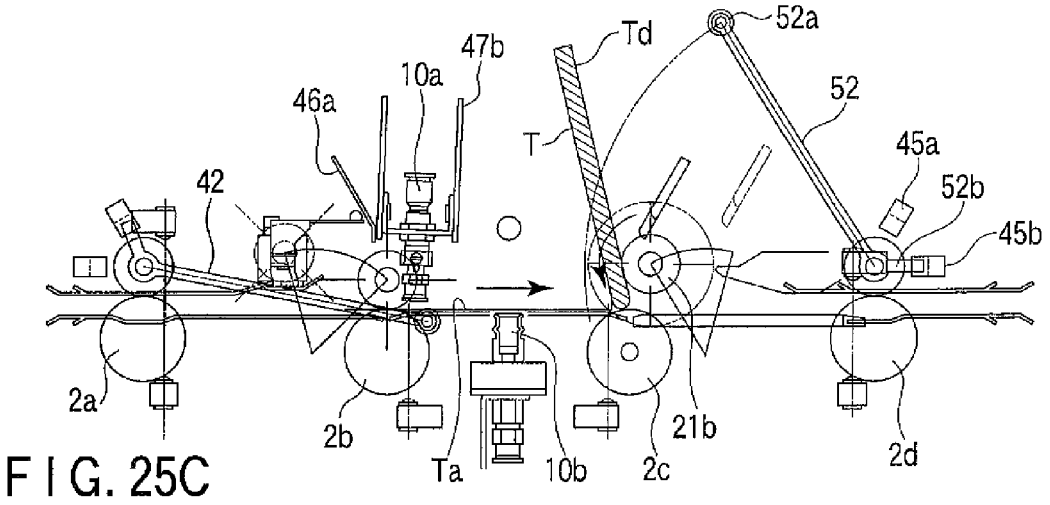
FIG. 25C is a view showing a state in which the pages on the back cover side of the booklet in FIG. 25B are folded.

From this state, the booklet T is further fed to the right side, as indicated by the arrow in FIG. 25 so that the lower side of the pages on the side of the back cover Td comes into contact with pinch rollers 21*b*. At this time, the vacuum pads 10*a* retreat to the lower left side to avoid interference with the pages on the side of the back cover Td of the booklet T. After that, the booklet T is further fed to the right side, as indicated by the arrow in FIG. 26A. The pages on the side of the back cover Td are introduced between a feed roller 2*c* and the pinch rollers 21*b* and folded. At this time, the pages on the side of the back cover Td come into contact with a second guide plate 47*b* so as to be guided. Simultaneously, the lifting arm 52 pivots downward so that the distal end portion 52*a* pushes the pages on the side of the back cover Td of the booklet down to assist the folding operation.

Figure 26A:
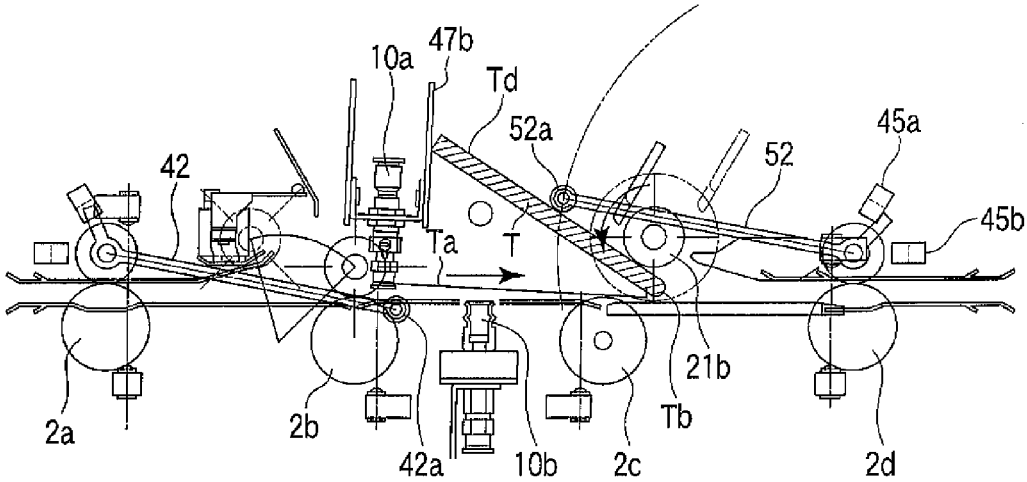
FIG. 26A is a view showing a state in which the pages on the back cover side of the booklet in FIG. 25C are folded while being pushed down by the lifting arm.
Figure 26B:
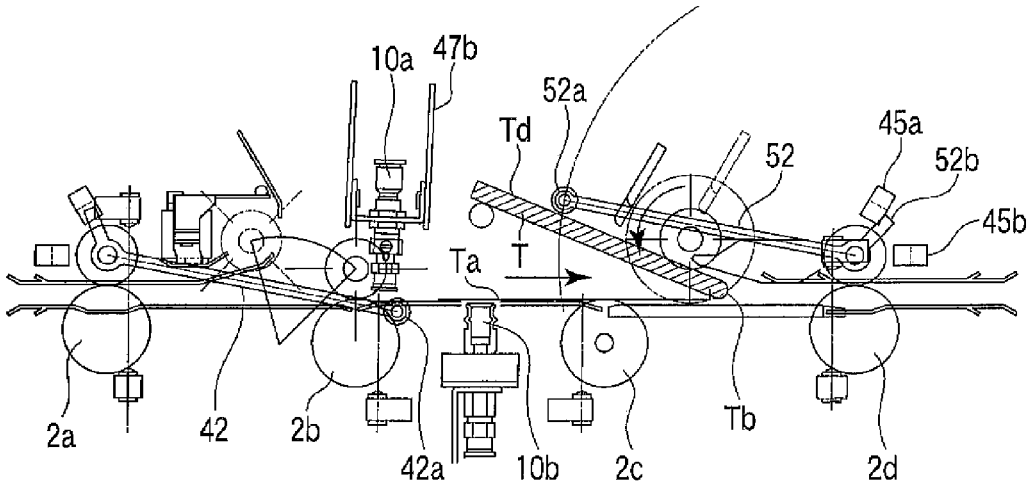
FIG. 26B is a view showing a state in which the pages on the back cover side of the booklet in FIG. 26A are folded while being further pushed down.
Figure 26C:
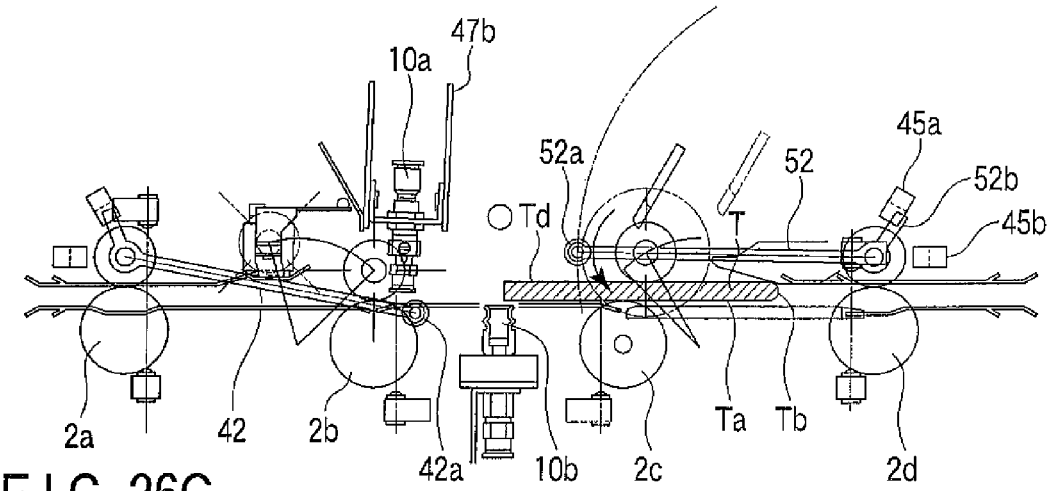
FIG. 26C is a view showing a state in which the pages on the back cover side of the booklet in FIG. 26B are completely folded.

The booklet T is then further fed to the right side as indicated by the arrow in FIG. 26B, and fed between the feed roller 2*c* and the pinch rollers 21*b* to fold the pages on the side of the back cover Td, as shown in FIG. 26C.

Figure 27A:
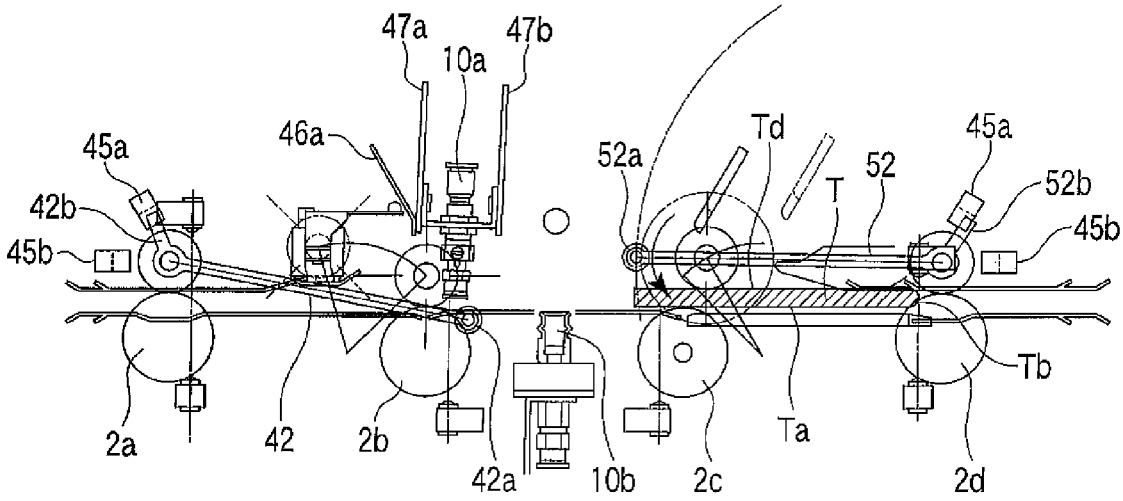
FIG. 27A is a view showing a state in which the booklet in FIG. 26C has passed the distal end portion of the lifting arm.
Figure 27B:
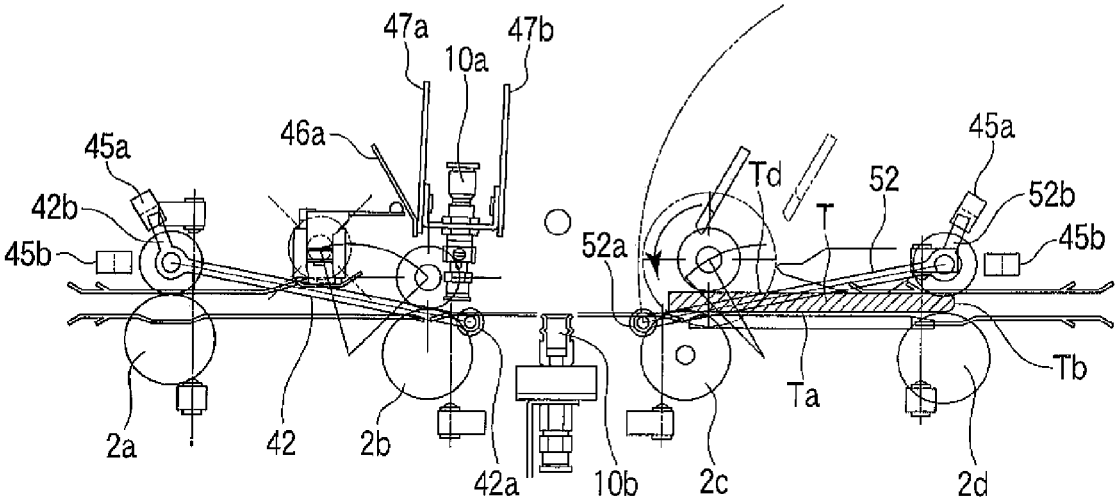
FIG. 27B is a view showing a state in which the lifting arm in FIG. 27A moves down to the initial position.

The folded booklet T is further fed to the right side, as shown in FIG. 27A. When the trailing edge in the feed direction passes through the distal end portion 52*a* of the lifting arm 52, as shown in FIG. 27B, the lifting arm 52 further pivots downward and returns to the standby position.

The booklet T thus folded has the same state as that of the booklet T inserted in the back cover face-up state shown in FIG. 18A described above. As described with reference to FIGS. 18B to 18E, the folded booklet T is fed to the page turning position 5, as shown in FIG. 18B. After the state shown in FIG. 18C, the vacuum pads 10*a* perform the right turning operation at the page turning position 5, as shown in FIG. 18D. The back cover Td is turned, as shown in FIG. 18E. A print surface Tc is turned and printed, and the booklet T is then discharged.

In the second embodiment as well, it is possible to lift and fold the pages at once even in a hard booklet, not to mention a soft booklet, as in the first embodiment.

Note that FIGS. 28A to 28E show processing executed when the booklet T is inserted in an upside down state.

Figure 28A:
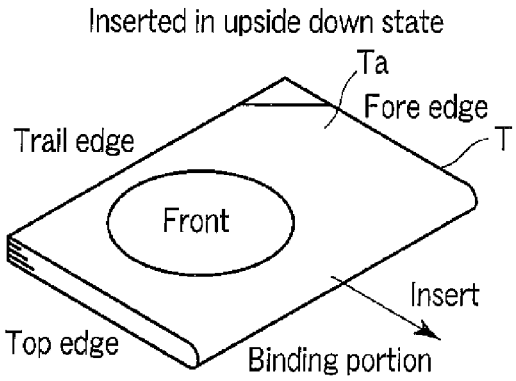
FIG. 28A is a perspective view showing a booklet inserted in an upside down state.
Figure 28B:
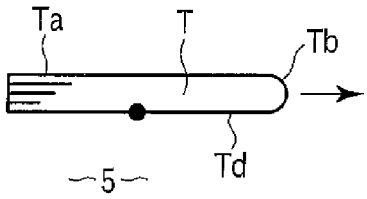
FIG. 28B is a view showing a state in which the booklet in FIG. 28A is fed to the turning position.
Figure 28C:
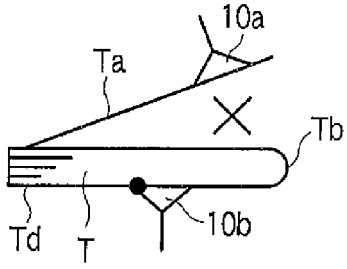
FIG. 28C is a view showing a state in which the front cover of the booklet in FIG. 28B cannot be turned up.
Figure 28D:
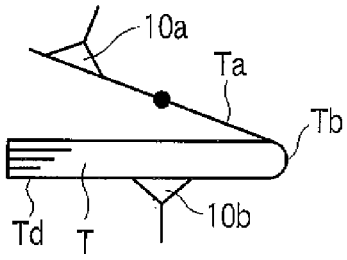
FIG. 28D is a view showing a state in which the front cover of the booklet in FIG. 28C is turned up.
Figure 28E:
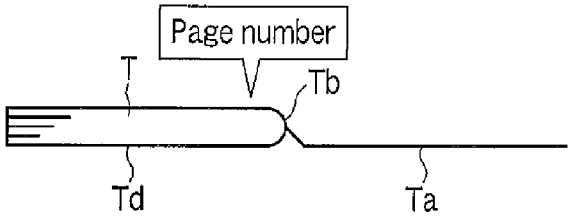
FIG. 28E is a view showing a state in which the front cover of the booklet in FIG. 28D is open.

More specifically, when the booklet T is inserted, as shown in FIG. 28A, and reaches the page turning position 5, as shown in FIG. 28B, the vacuum pads 10*a* perform left turning as in the normally inserted state, as shown in FIG. 28C. However, since the vacuum pads 10*a* are going to suck and lift the binding portion side, the upper vacuum pads 10*a* and lower vacuum pads 10*b* pull against each other. In this case, the upper vacuum pads 10*a* always release the booklet T. A control unit 40 determines that the binding portion of the inserted booklet T is located on the right side. Hence, a right turning operation is performed, as shown in FIG. 28D, and the page number is read, as shown in FIG. 28E, thereby normally ending the processing.

FIGS. 29A to 29E show processing executed when the booklet T is inserted in a back cover face-up upside down state.

Figure 29A:
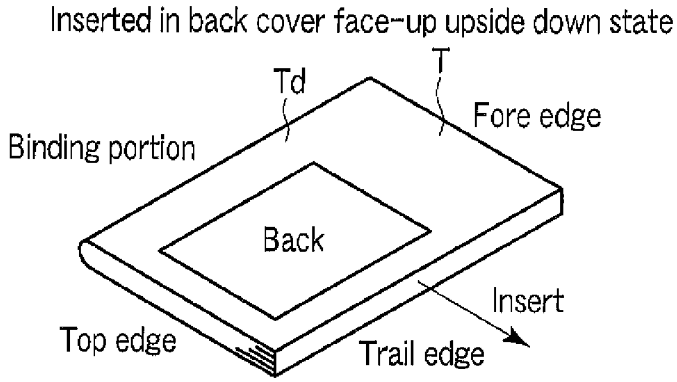
FIG. 29A is a perspective view showing a booklet inserted in a back cover face-up upside down state.
Figure 29B:
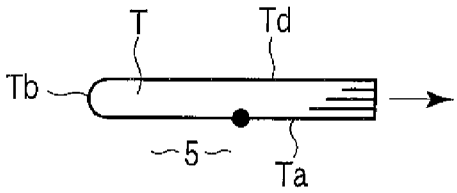
FIG. 29B is a view showing a state in which the booklet in FIG. 29A is fed to the turning position.
Figure 29C:
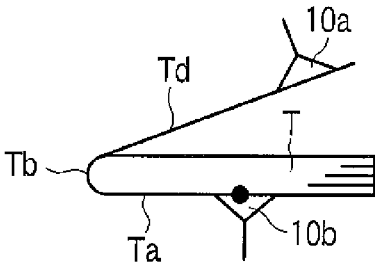
FIG. 29C is a view showing a state in which the back cover of the booklet in FIG. 29B is turned up.
Figure 29D:
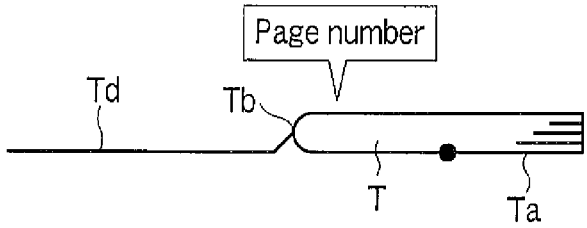
FIG. 29D is a view showing a state in which the back cover of the booklet in FIG. 29C is open.
Figure 29E:
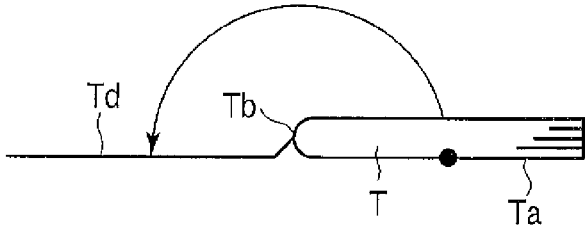
FIG. 29E is a view showing a state in which the pages on the front cover side of the booklet in FIG. 29D are closed at once.

More specifically, when the booklet T is inserted, as shown in FIG. 29A, and reaches the page turning position 5, as shown in FIG. 29B, the left turning operation is performed as the page turning position 5, as shown in FIG. 29C, and the page number is read, as shown in FIG. 29D. After the reading, the side of the front cover Ta is lifted and closed at once, as shown in FIG. 29E, thereby obtaining the state shown in FIG. 28D described above.

According to the above-described method, normal turning processing can automatically end regardless of the inserted state of the booklet T.

Third Embodiment

FIGS. 30A to 30C to FIGS. 33A to 33C show a page turning apparatus according to the third embodiment of the present invention.

Note that the same reference numerals as in the above-described second embodiment denote the same parts, and a detailed description thereof will not be repeated.

In the above-described second embodiment, the first and second lifting arms 42 and 52 are provided. In the third embodiment, a lifting cam 62 serving as a lifting device is provided between feed rollers 2*b* and 2*c* in place of the lifting arms 42 and 52. The lifting cam 62 is made to pivot about a rotating shaft 62*a* in the forward and backward directions by a pulse motor. Its rotation amount can arbitrarily be changed by pulse control of the pulse motor.

As the lifting cam 62, a metal or resin member that produces little friction and reduces the contact resistance is adopted to prevent damage to a booklet T. A pair of sensors 63*a* and 63*b* configured to detect the position of the lifting cam 62 is disposed near the lifting cam 62. The pair of sensors 63*a* and 63*b* detect the pivot amount of the lifting cam 62 for positioning control.

A case will be described next with reference to FIGS. 30A to 30C and FIGS. 31A to 31C, in which the booklet T is inserted in a back cover face-up state, and the pages on the front cover side are folded at once.

Figure 30A:
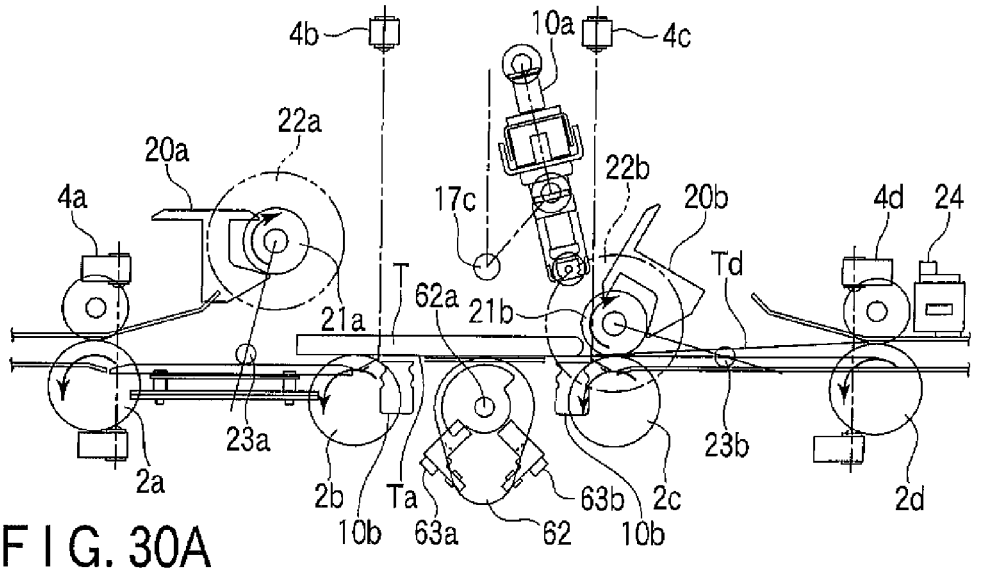
FIG. 30A is a view showing a state in which the back cover of a booklet inserted in an inverted state is open, and the pages on the front cover side of the booklet are fed to the turning position in a page turning apparatus according to the third embodiment of the present invention.
Figure 30B:
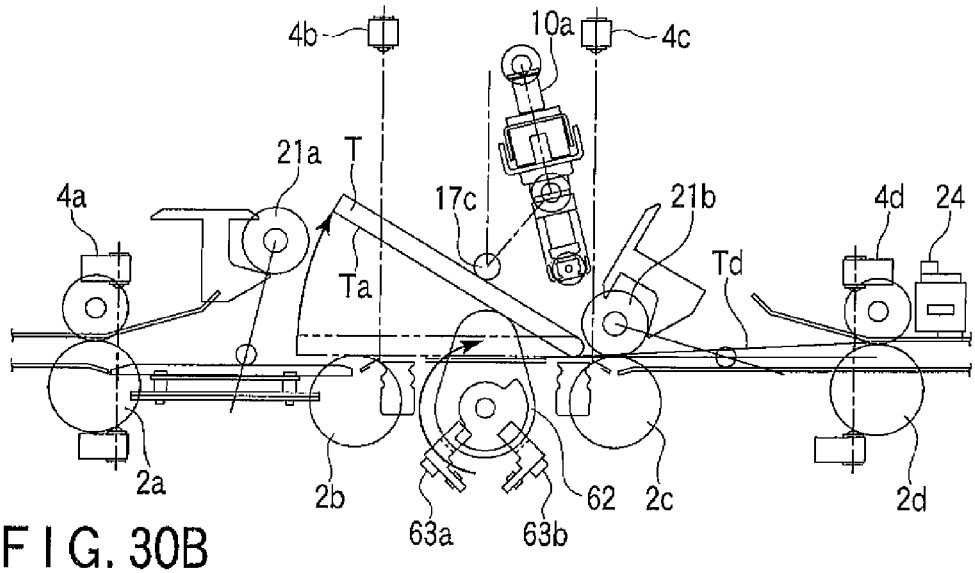
FIG. 30B is a view showing a state in which the pages on the front cover side of the booklet in FIG. 30A are lifted at once.

FIG. 30A illustrates a state in which after opening a back cover Td of the booklet T and performing barcode reading processing, the booklet T is fed to a page turning position 5 by the feed rollers 2*b*, 2*c*, and 2*d*. In this state, the lifting cam 62 pivots upward from the initial position in the clockwise direction as indicated by the arrow to lift the pages on the front cover side of the booklet T at once, as shown in FIG. 30B.

Figure 30C:
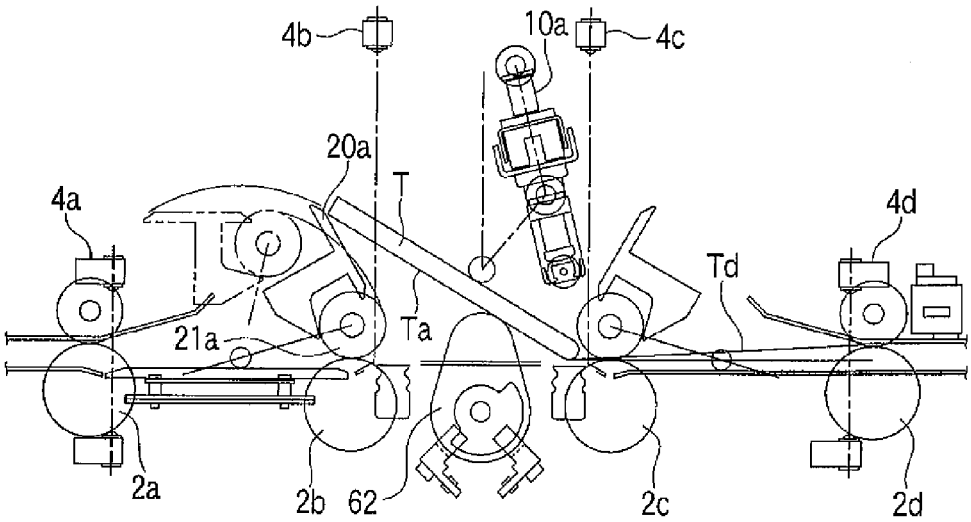
FIG. 30C is a view showing a state in which pinch rollers have moved under the pages on the front cover side of the booklet in FIG. 30B.
Figure 31A:
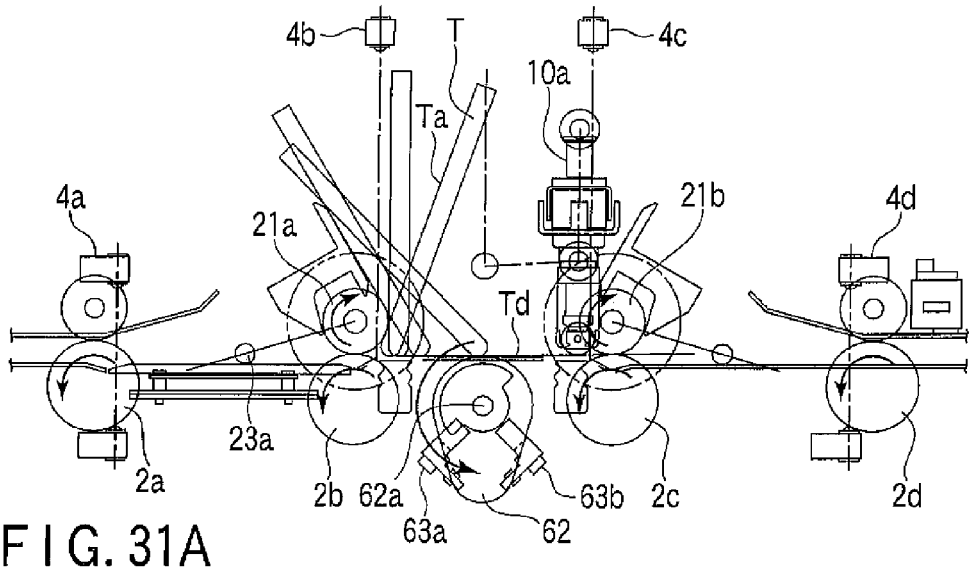
FIG. 31A is a view showing a state in which the pages on the front cover side of the booklet in FIG. 30C are folded.
Figure 31B:
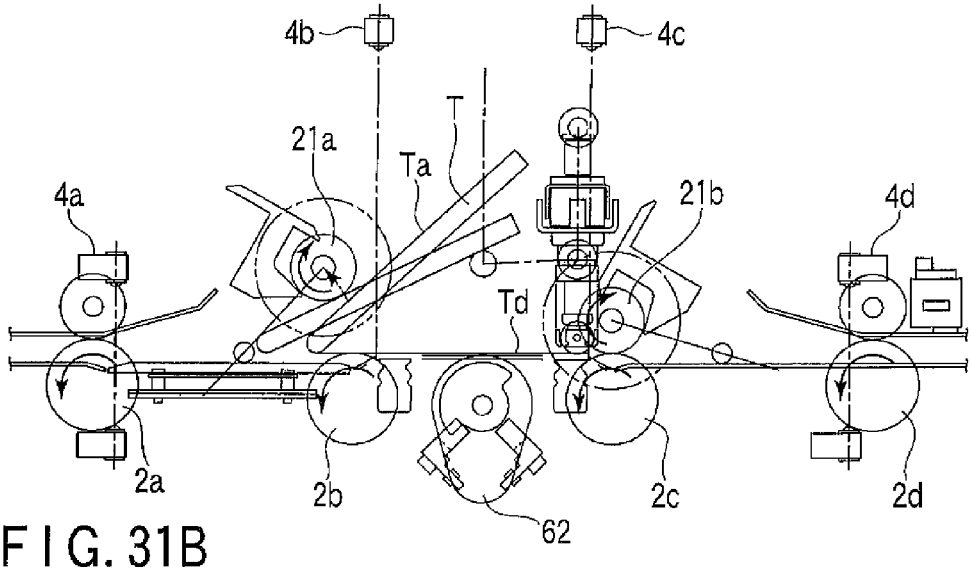
FIG. 31B is a view showing a state in which the pages on the front cover side of the booklet in FIG. 31A are further folded.
Figure 31C:
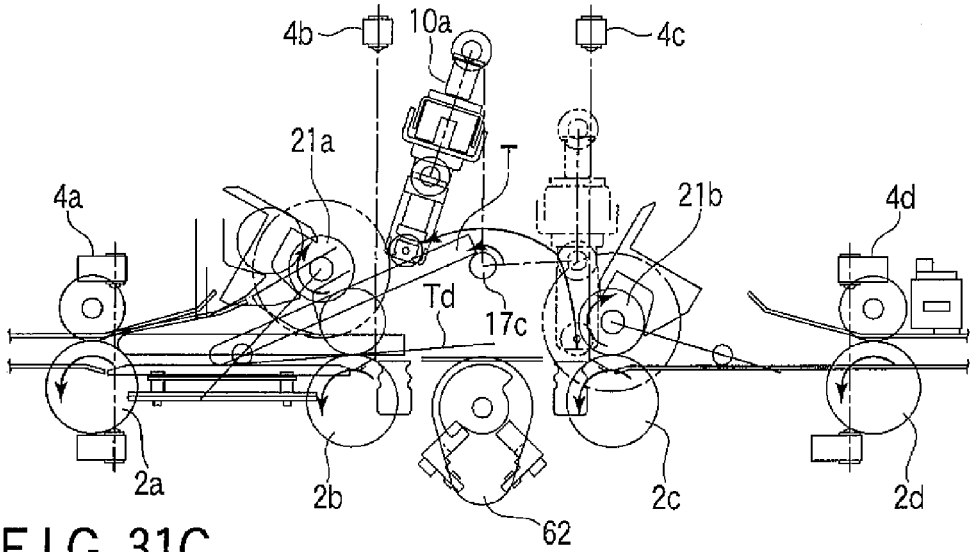
FIG. 31C is a view showing a state in which a vacuum pump assists folding pages on the front cover side of the booklet in FIG. 31B.

After the lifting, pinch rollers 21*a* and a guide plate 67*a* move under the lifted pages on the front cover side, as shown in FIG. 30C. After the movement, as shown in FIG. 31A, the lifting cam 62 pivots counterclockwise and retreats to the initial position, as indicated by the arrow. The booklet T is fed to the left side as the pinch rollers 21*a* and the feed rollers 2*b*, 2*c*, and 2*d* rotate. Upon this feed, vacuum pads 10*a* retreat downward not to interfere with the folding operation of the booklet T at a timing a sensor 4*d* changes from "dark" to "light". In addition, at a timing a sensor 4*b* changes from "dark" to "light", a parallel link mechanism 23*a* pivots to move the pinch rollers 21*a* and the guide plate 67*a* to the upper standby position, as shown in FIG. 31B. After the movement, the pinch rollers 21*a* and 21*b* and the feed rollers 2*b*, 2*c*, and 2*d* are driven to further feed the booklet T to the left side. Upon this feed, the pages on the front cover side of the booklet T come into contact with the pinch rollers 21*a* so as to be pushed down. At this time, as shown in FIG. 31C, the vacuum pads 10*a* move obliquely upward, as indicated by the arrow, and a shaft 17*c* rotates in the direction of the arrow to assist pushing the pages on the front cover side of the booklet down. When the booklet T is further fed to the left side, and a detection sensor 4*c* changes from "dark" to "light", the folding operation of the booklet T ends.

A case will be described next with reference to FIGS. 32A to 32C and FIGS. 33A to 33C, in which the booklet T is inserted in a normal state, and the pages on the back cover side are folded at once.

Figure 32A:
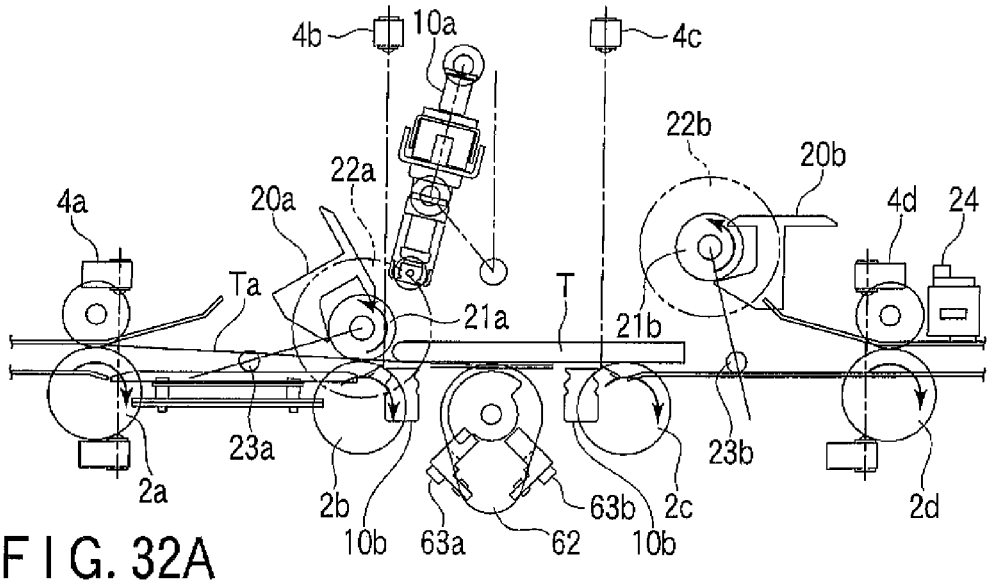
FIG. 32A is a view showing a state in which the front cover of a booklet inserted in a normal state is opened, and the pages on the back cover side of the booklet are fed to the turning position.
Figure 32B:
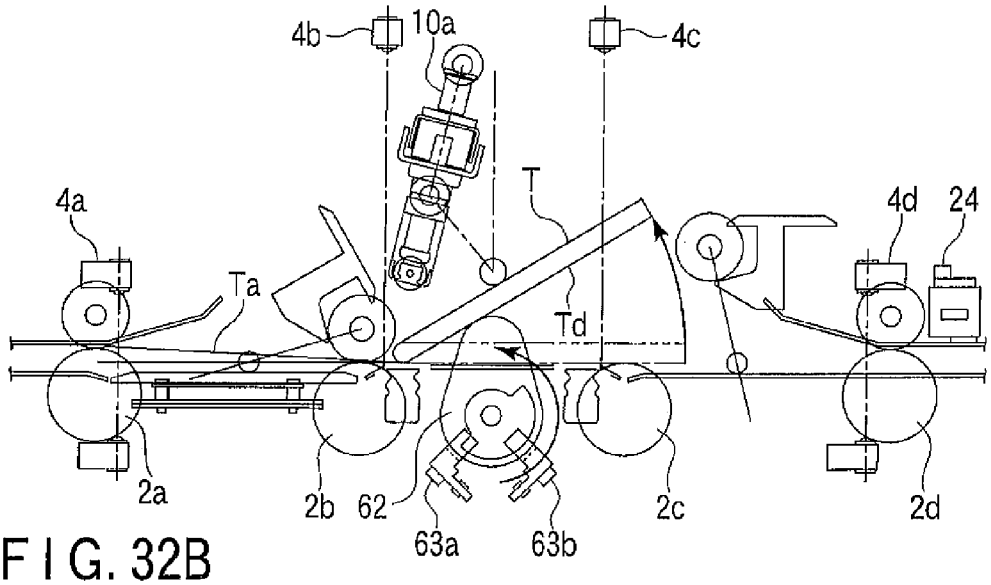
FIG. 32B is a view showing a state in which the pages on the back cover side of the booklet in FIG. 32A are lifted at once.
Figure 32C:
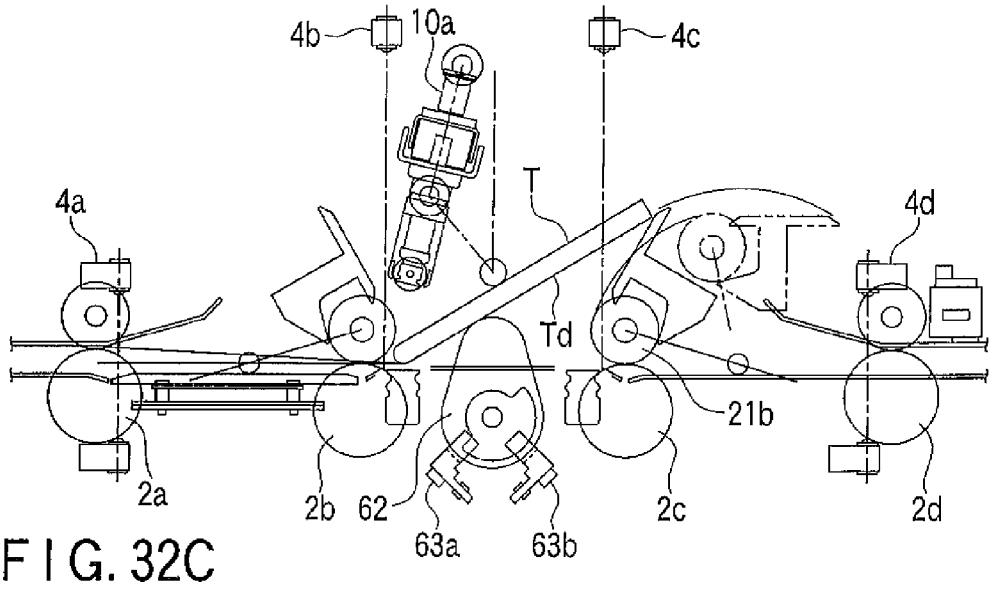
FIG. 32C is a view showing a state in which the pinch rollers have moved under the pages on the back cover side of the booklet in FIG. 32B.
Figure 33A:
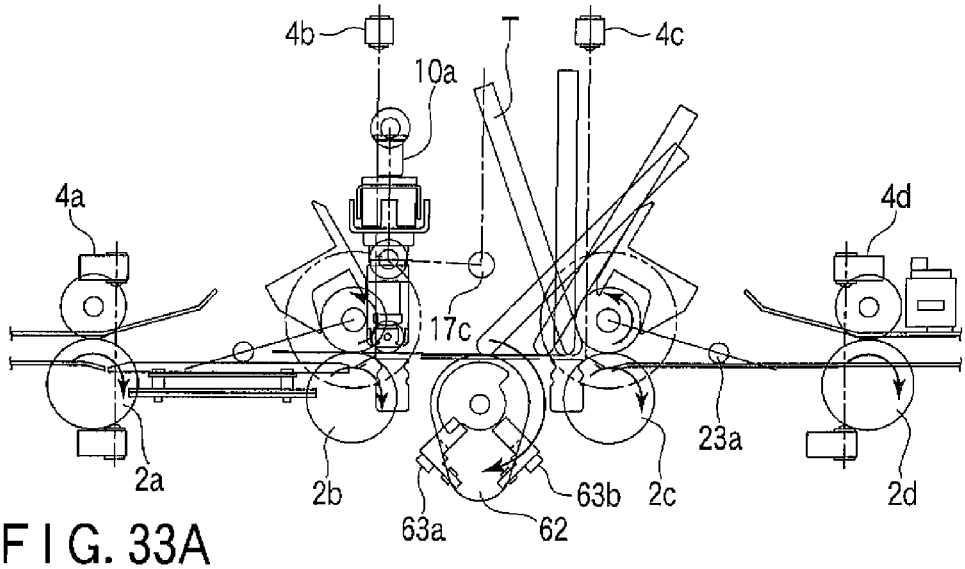
FIG. 33A is a view showing a state in which the pages on the back cover side of the booklet in FIG. 32C are folded.
Figure 33B:
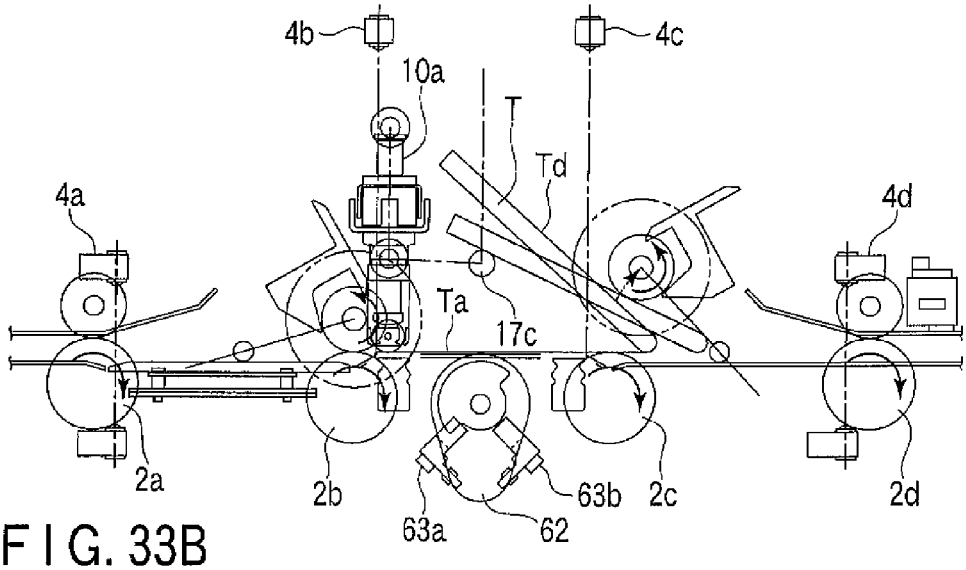
FIG. 33B is a view showing a state in which the pages on the back cover side of the booklet in FIG. 33A are further folded.
Figure 33C:
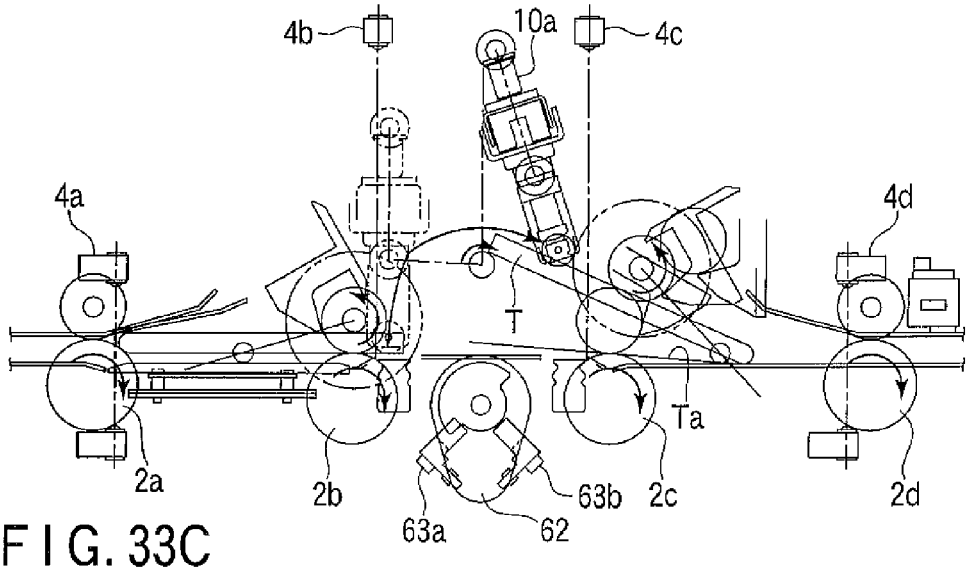
FIG. 33C is a view showing a state in which the vacuum pump assists folding pages on the back cover side of the booklet in FIG. 33B.

FIG. 32A shows a state in which the pages on the back cover side of the booklet T with an opened front cover Ta are located at a turning position 5. In this state, the lifting cam 62 pivots upward from the initial position in the counterclockwise direction as indicated by the arrow to lift the pages on the back cover side of the booklet T at once, as shown in FIG. 32B. After the lifting, the pinch rollers 21*b* and a guide plate 67*b* move under the lifted pages on the back cover side, as shown in FIG. 32C. After the movement, as shown in FIG. 33A, the lifting cam 62 pivots clockwise and retreats to the initial position, as indicated by the arrow. The booklet T is fed to the right side as the pinch rollers 21*a* and the feed rollers 2*b*, 2*c*, and 2*d* rotate. Upon this feed, the vacuum pads 10*a* retreat downward not to interfere with the folding operation of the booklet T at a timing a sensor 4*a* changes from "dark" to "light". In addition, at a timing the sensor 4*b* changes from "dark" to "light", a parallel link mechanism 23*b* pivots to move the pinch rollers 21*b* and the guide plate 67*b* to the upper standby position, as shown in FIG. 33B. After the movement, the pinch rollers 21*a* and 21*b* and the feed rollers 2*b*, 2*c*, and 2*d* are driven to further feed the booklet T to the right side. Upon this feed, the pages on the back cover side of the booklet T come into contact with the pinch rollers 21*b* so as to be pushed down. At this time, as shown in FIG. 33C, the vacuum pads 10*a* move obliquely upward, as indicated by the arrow, and the shaft 17*c* rotates in the direction of the arrow to assist pushing the pages on the back cover side of the booklet T down. When the booklet T is further fed to the right side, and the detection sensor 4*c* changes from "dark" to "light", the folding operation of the booklet T ends.

Figure 34:
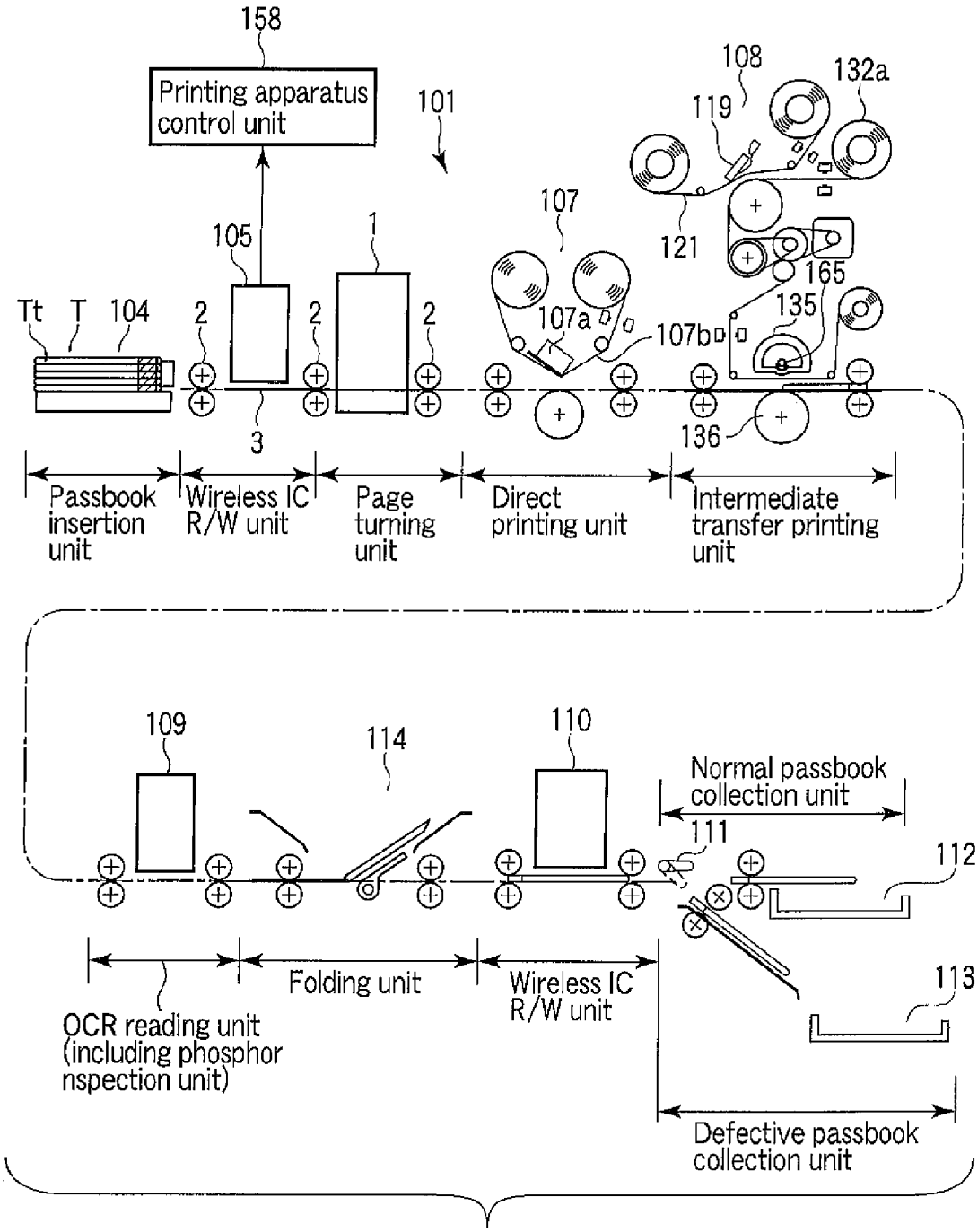
FIG. 34 is a schematic view showing an ID printing apparatus incorporating a page turning apparatus.

FIG. 34 is a view showing the overall arrangement of an ID printing apparatus 101 incorporating one of the page turning apparatuses 1 described in the above embodiments.

The ID printing apparatus 101 comprises a booklet insertion unit 104. A plurality of closed booklets T are stacked and set in the booklet insertion unit 104 and inserted one by one. The inserted booklet T is fed along a feed path 3 by a plurality of pairs of feed rollers 2. A first wireless IC R/W (Reader/Writer) unit 105, page turning apparatus 1, direct printing unit 107, intermediate transfer printing unit 108, OCR reading unit 109, booklet folding unit 114, and second wireless IC R/W unit 110 are disposed in the feed path 3 along the feed direction of the booklet T.

A discharge gate 111 configured to switch the discharge direction of the booklet T between a first direction and a second direction is provided on the discharge end side of the feed path 3. A normal booklet collection unit 112 which collects normal booklets T is arranged in the first direction. A defective booklet collection unit 113 which collects defective booklets is arranged in the second direction.

The above-described booklet insertion unit 104 can insert a plurality of booklets T in the stacked state. In accordance with an instruction from the control unit, a picker (not shown) extracts only the lowermost booklet and inserts it toward the first wireless IC R/W unit 105.

The first wireless IC R/W unit 105 reads, by wireless communication, booklet-specific ID information and control information which are recorded in the wireless IC incorporated in the booklet T.

The page turning apparatus 1 has a function of turning the front cover of the booklet T inserted from the booklet insertion unit 104 and also turning the inner sheets, as described above. A turned page is recognized by causing a bar mark reader to read a bar mark printed on the booklet T from the first.

The direct printing unit 107 presses an ink ribbon 107*b* and a thermal head 107*a* in this order against a print page surface of the booklet T to print. The thermal head 107*a* generates heat to print an image or characters. In this embodiment, the direct printing unit 107 prints information of lower security level than that of information to be printed by the intermediate transfer printing unit 108.

Note that not all pages of the booklet T are printed by the direct printing unit 107. In addition, the pages to be printed by the direct printing unit 107 are different from those to be printed by the intermediate transfer printing unit 108. For this reason, when printing of the direct printing unit 107 has occurred, the page turning apparatus 1 turns the page to be printed, and direct printing is performed first. Then, the booklet T is fed to the page turning apparatus 1 again to turn the page to be subjected to intermediate transfer printing. If there exists no information to be printed by the direct printing unit 107, the booklet T passes through the direct printing unit 107.

Figure 35:
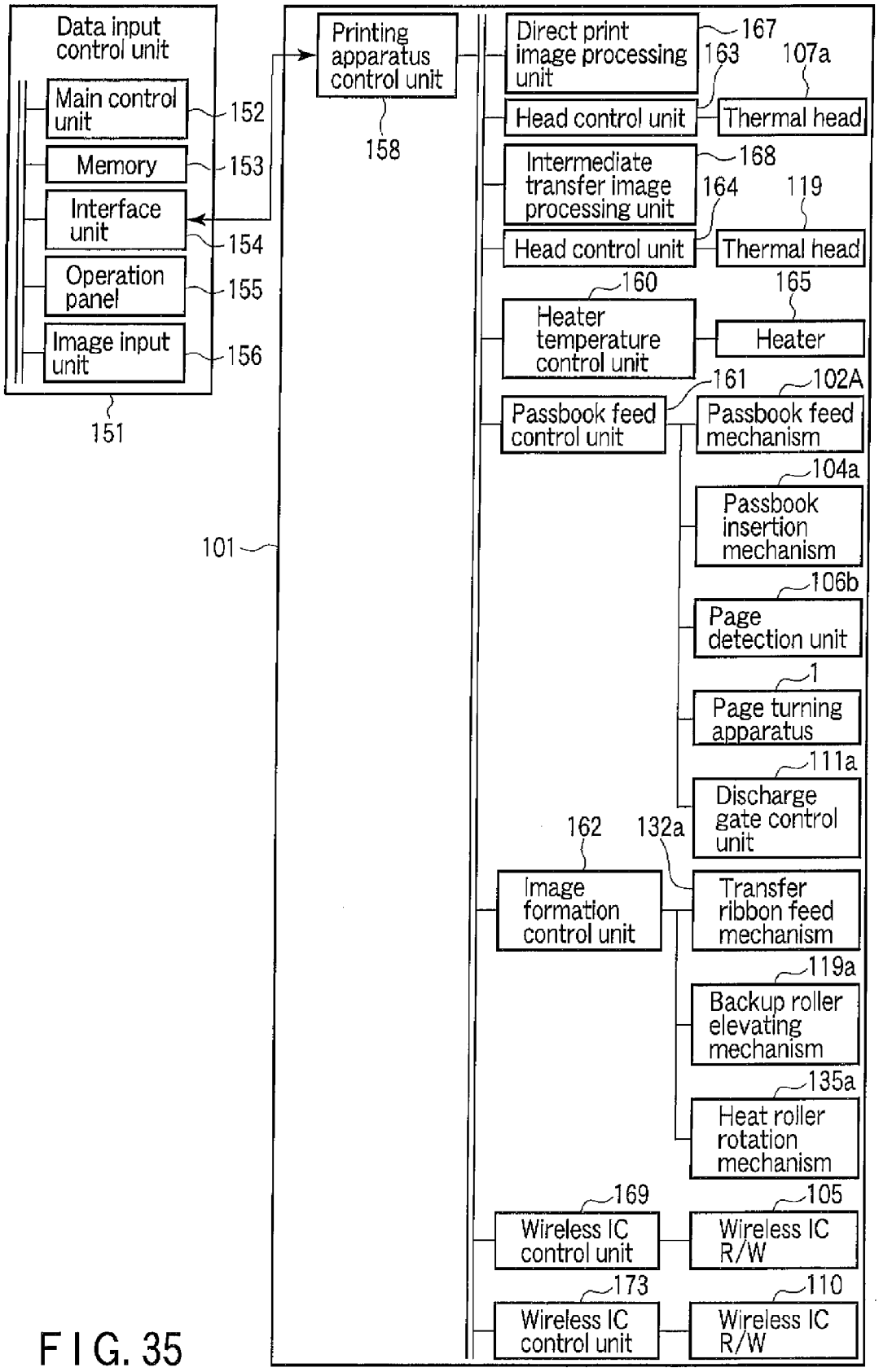
FIG. 35 is a block diagram showing the driving control system of the ID printing apparatus in FIG. 34.

FIG. 35 is a block diagram showing the driving control system of the above-described ID printing apparatus 101.

Referring to FIG. 35, the ID printing apparatus 101 is connected to a data input control unit 151. The data input control unit 151 includes a main control unit 152. A memory 153, interface unit 154, operation panel 155, and image input unit 156 are connected to the main control unit 152 via control circuits.

The printing apparatus 101 includes an apparatus control unit 158. A direct print image processing unit 167, intermediate transfer image processing unit 168, heater temperature control unit 160, booklet feed control unit 161, image formation control unit 162, and wireless IC control units 169 and 173 are connected to the apparatus control unit 158 via control circuits.

A head control unit 163 configured to control the print operation of the thermal head 107*a* is connected to the above-described direct print image processing unit 167. A head control unit 164 configured to control the print operation of a thermal head 119 is connected to the intermediate transfer image processing unit 168.

A heater 165 of a heat roller 135 shown in FIG. 34 is connected to the heater temperature control unit 160 via a control circuit. A booklet feed mechanism 102A, booklet insertion mechanism 104*a*, page detection unit 106*b*, page turning apparatus 1, and discharge gate control unit 111*a* are connected to the booklet feed control unit 161 via control circuits.

A transfer ribbon feed mechanism 132*a*, a backup roller elevating mechanism 119*a* which elevates a backup roller 136 shown in FIG. 34, and a rotation mechanism 135*a* which rotates the heat roller 135 are connected to the image formation control unit 162 via control circuits.

The wireless IC R/W units 105 and 110 are connected to the wireless IC control units 169 and 173, respectively.

The print operation of the ID printing apparatus 101 having the above-described arrangement will be explained next.

The booklets T are extracted from the booklet insertion unit 104 shown in FIG. 34 and fed to the page turning apparatus 1 one by one. The front cover Ta of the booklet T is turned in the above-described way to open a predetermined page. The wireless IC R/W 105 reads booklet-specific information data and control data recorded in the wireless IC of the booklet T. The read information data are sent to the printing apparatus control unit 158.

The printing apparatus control unit 158 also receives holder's color face image data acquired by the image input unit 156 and holder's security character information input via the operation panel 155. Print data is generated based on the holder's color face image data, holder's security character information, booklet-specific information, and control information data sent to the printing apparatus control unit 158. The intermediate transfer image processing unit 168 operates the thermal head 119 to print the holder's face image on the surface of an intermediate transfer film 121 by color printing based on the print data by overprinting four color inks, i.e., three primary color inks of Y (yellow), M (magenta), and C (cyan) and black ink. The overprinting of the plurality of color inks is done by reciprocally moving the thermal head 119 on the intermediate transfer film 121 as many times as the number of color inks. The information to be printed is an inverted image. Note that the print color inks may include a functional ink such as an ink containing a fluorescent pigment in addition to the above-described four color inks.

After the color printing of the holder's face image, the thermal head 119 prints the security information added with the booklet-specific information on the surface of the intermediate transfer film 121.

The intermediate transfer film 121 on which the color face image and the security information added with the booklet-specific information are thus printed is wound in the forward direction (the direction of the heat roller 135).

At this time, the booklet T is inserted with the transfer page open and fed to a predetermined position with respect to the heat roller 135. The transfer page can be either the front cover flyleaf or any, other inner page.

The intermediate transfer film 121 and the page of interest of the booklet T, which are positioned to each other in the above-described way, are overlaid and fed as the metal heat roller 135 with a partially cutout circumference rotates, and simultaneously pressed and heated. After that, the transfer film base is pulled up at an angle of 60° to 110° with respect to the booklet T. Transfer of the specific print information, image receiving and adhesion layer, and hologram layer is completed so that the security information containing the transferred specific information and formed from numbers, characters, symbols, barcode, and the like and the holder's color face image area are transferred. The booklet T that has undergone the transfer is fed to the OCR reading unit 109 while keeping the page open.

The OCR reading unit 109 reads the booklet-specific information and security information. The read booklet-specific information and security information are recognized, and the recognition result is sent to the printing apparatus control unit 158. The printing apparatus control unit 158 collates the data and sends the determination result to the booklet feed control unit 161.

Upon determining based on the data collation result that the booklet is defective, the printing apparatus control unit 158 notifies the data input control unit 151 and the wireless IC control unit 173 that the created booklet is defective.

Upon receiving the notification representing that the created booklet is defective, the data input control unit 151 sends the same print processing instruction to the printing apparatus control unit 158 again to automatically re-create the booklet.

The booklet T which has passed through the OCR reading unit 109 is fed to the booklet folding unit 114, folded, and then fed to the wireless IC R/W unit 110. If the booklet is defective, the wireless IC R/W unit 110 records, on the wireless IC of the booklet T, data representing that the booklet is defective.

On the other hand, if the collation result of the data read by the OCR reading unit 109 is correct, data to be recorded on the wireless IC is generated based on the print data generated by the printing apparatus control unit 158, and sent to the wireless IC control unit 173. Based on this sending, the wireless IC R/W unit 110 records (writes) the security information added with the booklet-specific information on the wireless IC of the booklet T.

The discharge gate 111 operates to discharge normal booklets T for which the wireless IC R/W unit 110 has recorded the information on the wireless IC to the normal booklet collection unit 112, and defective booklets to the defective booklet collection unit 113 so as to collect the booklets.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A booklet page turning apparatus comprising:

a feed device which feeds a closed booklet containing a plurality of sheets to a page turning position;

a page turning device which turns, about a binding portion, at least one sheet on one side of the booklet fed to the page turning position by the feed device;

a lifting device which lifts the remainder of the sheets on the other side upward at a predetermined angle about the binding portion the other side being different from the sheet on the one side;

a contact roller unit which enters under the remainder of the sheets on the other side lifted by the lifting device; and a control device which controls the feeding device to feed the booklet to the page turning position again after the feed device has fed the booklet so as to bring the remainder of the sheets on the other side of the booklet into contact with the contact roller unit and turned onto the sheet on the one side.

2. The apparatus according to claim 1, wherein the lifting device comprises a lifting arm, and lifts the sheet on the other side of the booklet by bringing a distal end portion of the lifting arm into contact with the sheet.

3. The apparatus according to claim 2, wherein the distal end portion of the lifting arm is formed from a shaft made of one of a metal and a resin.

4. The apparatus according to claim 2, wherein the distal end portion of the lifting arm is formed from a rotatable roller made of one of a metal and a resin.

5. The apparatus according to claim 1, wherein the lifting arm pivots upward to make a pivotal end portion lift the sheet on the other side of the booklet, and when the sheet is lifted at not less than a predetermined angle, releases and drops the sheet from the pivotal end portion, and the apparatus further comprises a first guide unit which receives and guides the dropped sheet on the other side of the booklet; and a second guide unit which receives and guides the sheet on the other side of the booklet, the sheet being brought into contact with the contact roller unit and folded.

6. The apparatus according to claim 1, wherein the lifting device comprises a first lifting arm and a second lifting arm disposed to be symmetric with each other about the page turning position, and lifts the sheet on the other side of the booklet by selectively using the first lifting arm and the second lifting arm in accordance with an inserted state of the booklet.

7. The apparatus according to claim 6, wherein a distal end portion of each of the first lifting arm and the second lifting arm is formed from a shaft made of one of a metal and a resin.

8. The apparatus according to claim 6, wherein a distal end portion of each of the first lifting arm and the second lifting arm is formed from a rotatable roller made of one of a metal and a resin.

9. The apparatus according to claim 1, wherein the lifting device comprises a lifting cam, and lifts the sheet on the other side of the booklet by bringing a distal end portion of the lifting cam into contact with the sheet.

10. The apparatus according to claim 9, wherein the lifting cam is made of one of a metal material and a resin material.

11. The apparatus according to claim 1, wherein the sheet turning device comprises a vacuum pad which sucks and moves a sheet of the booklet, thereby turning the page.

12. The apparatus according to claim 11, wherein the vacuum pad assists turning the sheet on the other side of the booklet.

13. A booklet page turning method comprising:

feeding, by a feed device, a closed booklet containing a plurality of sheets to a page turning position;

turning, about a binding portion, at least one sheet on one side of the booklet fed to the page turning position;

lifting, by a lifting device, the remainder of the sheets on the other side upward at a predetermined angle about the binding portion, the other side being different from the sheet on the one side;

causing a contact roller unit to enter under remainder of the sheets on the other side lifted by the lifting device; and controlling the feed device to feed the booklet to the page turning position again after the feed device has fed the booklet so as to bring the remainder of the sheets on the other side of the booklet into contact with the contact roller unit and turned onto the sheet on the one side.

14. The method according to claim 13, wherein the lifting device comprises a lifting arm, and lifts the on the other side of the booklet by making the lifting arm pivot upward to bring a pivotal end portion into contact with the page.

15. The method according to claim 13, wherein the lifting device comprises a lifting cam, and lifts the sheet on the other side of the booklet by making the lifting cam pivot upward and bringing the lifting cam into contact with the sheet.

16. The method according to claim 13, wherein the page turning device comprises a vacuum pad and turns a sheet of the booklet by causing the vacuum pad to suck and move the sheet.

17. The method according to claim 16, wherein the vacuum pad assists turning the sheet on the other side of the booklet.

18. An ID printing apparatus comprising:

a feed device which feeds a closed booklet containing a plurality of sheets to a page turning position;

a page turning device which turns, about a binding portion, at least one sheet on one side of the booklet fed to the page turning position by the feed device;

a lifting device which lifts the remainder of the sheets on the other side upward at a predetermined angle about the binding portion the other side being different from the sheet on the one side;

a contact roller unit which enters under the remainder of the sheets on the other side lifted by the lifting device; and a control device which controls the feeding device to feed the booklet to the page turning position again after the feed device has fed the booklet so as to bring the remainder of the sheets on the other side of the booklet into contact with the contact roller unit and turned onto the sheet on the one side; and a printing device which prints ID information on one of the sheets on the other side of the booklet turned by the page turning device.

19. The apparatus according to claim 18, wherein the lifting device comprises a lifting arm, and lifts the sheet on the other side of the booklet by bringing a distal end portion of the lifting arm into contact with the sheet.

20. The apparatus according to claim 18, wherein the lifting device comprises a lifting cam, and lifts the sheet on the other side of the booklet by bringing a distal end portion of the lifting cam into contact with the sheet.

* * * * *